US009496598B2

(12) United States Patent
Orihara et al.

(10) Patent No.: US 9,496,598 B2
(45) Date of Patent: Nov. 15, 2016

(54) WIRELESS COMMUNICATION SYSTEM, ANTENNA MODULE AND ELECTRONIC DEVICE

(71) Applicant: DEXERIALS CORPORATION, Tokyo (JP)

(72) Inventors: Katsuhisa Orihara, Tochigi (JP); Norio Saito, Tochigi (JP); Akihiro Fukuda, Tochigi (JP); Hiroyuki Ryoson, Tochigi (JP); Masayoshi Kanno, Tochigi (JP)

(73) Assignee: DEXERIALS CORPORATION, Tokyo (JP)

( * ) Notice: Subject to any disclaimer, the term of this patent is extended or adjusted under 35 U.S.C. 154(b) by 0 days.

(21) Appl. No.: 14/654,717

(22) PCT Filed: Nov. 14, 2013

(86) PCT No.: PCT/JP2013/080768

§ 371 (c)(1),
(2) Date: Jun. 22, 2015

(87) PCT Pub. No.: WO2014/097783

PCT Pub. Date: Jun. 26, 2014

(65) Prior Publication Data

US 2015/0333389 A1 Nov. 19, 2015

(30) Foreign Application Priority Data

Dec. 21, 2012 (JP) ..... 2012-280235

(51) Int. Cl.
*H01Q 7/08* (2006.01)
*H01Q 1/22* (2006.01)
(Continued)

(52) U.S. Cl.
CPC ..... *H01Q 1/2225* (2013.01); *H01Q 1/38* (2013.01); *H01Q 7/00* (2013.01); *H01Q 7/06* (2013.01);
(Continued)

(58) Field of Classification Search
CPC ..... H01Q 7/08; H01Q 1/243; H01Q 1/1271; H01Q 1/3275; H01Q 1/42; H01Q 1/1207
USPC ..... 343/788, 872, 878, 702, 713, 715
See application file for complete search history.

(56) References Cited

U.S. PATENT DOCUMENTS

2009/0224888 A1 9/2009 Caruana
2015/0268742 A1* 9/2015 Park ..... G06F 3/03545 345/179

FOREIGN PATENT DOCUMENTS

JP 2001-217640 A 8/2001
JP 2001-313515 A 11/2001
(Continued)

OTHER PUBLICATIONS

Feb. 18, 2014 International Search Report issued in International Patent Application No. PCT/JP2013/080768.

*Primary Examiner* — Joseph Lauture
(74) *Attorney, Agent, or Firm* — Oliff PLC

(57) ABSTRACT

Provided is a wireless communication system which has excellent communication characteristics even between antenna modules having antenna coils between which there is a large difference in outside diameter. The wireless communication system includes: a first antenna module including a first antenna coil; and a second antenna module including a second antenna coil and capable of communication by receiving a magnetic field transmitted from the first antenna module, in which the first antenna coil and the second antenna coil have mutually different outside diameters, and, out of the first antenna coil and the second antenna coil, the antenna coil having a larger outside diameter is formed in such a way that the area of an opening portion inside the innermost perimeter of an antenna pattern is not more than 120% of the outside diameter area of the other antenna coil having a smaller outside diameter.

18 Claims, 20 Drawing Sheets

(51) Int. Cl.

| | |
|---|---|
| ***H01Q 7/00*** | (2006.01) |
| ***H01Q 7/06*** | (2006.01) |
| ***H01Q 9/27*** | (2006.01) |
| ***H01Q 1/38*** | (2006.01) |
| *H01Q 1/12* | (2006.01) |
| *H01Q 1/24* | (2006.01) |
| *H01Q 1/32* | (2006.01) |
| *H01Q 1/42* | (2006.01) |

(52) U.S. Cl.

CPC ..... *H01Q 9/27* (2013.01); *H01Q 1/1207* (2013.01); *H01Q 1/1271* (2013.01); *H01Q 1/243* (2013.01); *H01Q 1/3275* (2013.01); *H01Q 1/42* (2013.01); *H01Q 7/08* (2013.01)

(56) References Cited

FOREIGN PATENT DOCUMENTS

| | | | |
|---|---|---|---|
| JP | 2002-246830 | A | 8/2002 |
| JP | 2005-108110 | A | 4/2005 |
| JP | 3933191 | B1 | 6/2007 |
| JP | 2007-214754 | A | 8/2007 |
| JP | 2007-281818 | A | 10/2007 |
| JP | 2008-035464 | A | 2/2008 |
| JP | 2011-015376 | A | 1/2011 |
| WO | 2013/114491 | A1 | 8/2013 |

* cited by examiner

WIRELESS COMMUNICATION SYSTEM, ANTENNA MODULE AND ELECTRONIC DEVICE

FIELD OF THE INVENTION

The present invention relates to a wireless communication system, an antenna module, and an electronic device which are configured to carry out interactive communication by using an antenna coil formed in the shape of a spiral coil. The present application claims priority based on Japanese Patent Application No. 2012-280235 filed in Japan on Dec. 21, 2012. The total contents of the patent application are to be incorporated by reference into the present application.

BACKGROUND ART

In recent years, wireless communication apparatuses are provided with RF antennas such as an antenna for telephone communication, an antenna for GPS, an antenna for wireless LAN/BLUETOOTH (registered trademark), and RFID (Radio Frequency Identification). Examples of an electric power transfer system to be used in the mode of a contactless charging system include an electromagnetic induction system, a radio wave receiving system, and a magnetic resonance system. Any of these systems makes use of electromagnetic induction or magnetic resonance between a primary coil and a secondary coil, and, for example, NFC (Near Field Communication) standards for RFID make use of electromagnetic induction.

It has been proposed that, in such short-distance wireless communication systems, for example, an antenna module is built in a portable electronic device, such as a smart phone or a tablet, and the portable electronic device serves as a transponder to receive a magnetic field from an external reader/writer, such as an automatic wicket machine, a key for office access, or a terminal for counter settlement, and perform data communication. Alternatively, it has been also proposed that a portable electronic device serves as a reader/writer to cause an IC card or an IC tag having an external antenna module incorporated therein to transmit a magnetic field, and thereby to read card information or tag information.

PRIOR-ART DOCUMENTS

Patent Document

Patent document 1: Japanese Patent Application Laid-Open No. 2008-35464

SUMMARY OF THE INVENTION

Problems to be Solved by the Invention

In a short-distance wireless communication system making use of electromagnetic induction, there is a risk that communication cannot be established in a case where there is a large difference in antenna coil size between an antenna module on a reader/writer side and an antenna module on the side of a transponder which is driven by a current generated in response to a magnetic field transmitted from the reader/writer.

For example, in a case where a cellular phone serving as a reader/writer is held toward a poster or the like having an IC tag attached thereto to acquire information of the poster (a coupon, a map, a campaign guide, and the like), an antenna coil incorporated in the cellular phone measures approximately 4 cm per side, which is larger in size than an antenna coil incorporated in the IC tag and measuring approximately 2 cm per side. Specifically, in an antenna module for NFC, an antenna coil built in a cellular phone or a smart phone has an outside diameter of 60 mm×50 mm in order to gain longer communication distance from a reader/writer, on the other hand, a small antenna coil incorporated in an IC tag or the like has an outside diameter of 20 mm×25 mm.

Here, a magnetic field transmitted from an antenna module on a cellular phone side has a higher magnetic flux density at a point closer to an antenna coil, on the other hand, has a lower magnetic flux density at a point farther from the antenna coil. The same goes for a magnetic field transmitted from an antenna module on an IC tag side. In short-distance wireless communication, antenna modules are made to come into approximately intimate contact with each other, thereby performing communication. Therefore, as illustrated in FIG. 20A, in a case where the difference in outside and inside diameter between antenna coils which communicate with each other is small, no problem will arise, but, as illustrated in FIG. 20B, in a case where the difference in outside and inside diameter between antenna coils which communicate with each other is large, there is a risk that a magnetic flux F transmitted from one antenna module does not reach the other antenna module, whereby inductive coupling cannot be achieved.

In addition, in response to recent requests for miniaturization and slimming down of portable electronic devices, in many cases, an antenna module on a cellular phone side is wound along the side edge of a casing of the device because of a limited arrangement space or the necessity for communication with a reader/writer provided with an antenna coil having a large diameter, and accordingly, the antenna module inevitably has a large outside diameter. Furthermore, in many cases, an antenna module is overlaid with a metal plate, such as a battery case or a reinforcing board, and built in therewith, and accordingly, an eddy current generated by absorption of a magnetic flux by the metal plate makes a magnetic flux bounce back, and thus, there is a risk that efficient inductive coupling cannot be performed.

On the other hand, it has been considered that a thick magnetic sheet is provided in order to efficiently introduce a magnetic flux between antenna coils between which there is a large difference in outside and inside diameter, but, there has been requested miniaturization and slimming down of an antenna module built in an electronic device, and therefore, slimming down of a magnetic sheet has been also demanded. Hence, it has been demanded that, between antenna modules communicating with each other and having antenna coils between which there is a large difference in outside and inside diameter, a magnetic sheet is made thinner and the amount of a magnetic material used is reduced, and at the same time, inductive coupling is secured and degradation of communication characteristics is prevented.

Hence, an object of the present invention is to provide a wireless communication system, an antenna module, and an electronic device, the wireless communication system that achieves excellent communication characteristics even between antenna module having antenna coils between which there is a large difference in outside diameter, in a short-distance wireless communication system.

Means to Solve the Problem

To solve the foregoing problems, a wireless communication system according to the present invention includes: a first antenna module including a first antenna coil; and a second antenna module including a second antenna coil and capable of communication by receiving a magnetic field transmitted from the first antenna module, in which the first antenna coil and the second antenna coil have mutually different outside diameters, and, out of the first and second antenna coils, an antenna coil having a larger outside diameter is formed in such a way that the area of an opening portion inside the innermost perimeter of an antenna pattern is not more than 120% of the outside diameter area of the other antenna coil having a smaller outside diameter.

An antenna module according to the present invention includes a first antenna coil and is configured to communicate by inductive coupling with a second antenna coil provided outside, in which the first antenna coil has an outside diameter larger than that of the second antenna coil, and is formed in such a way that the area of an opening portion inside the innermost perimeter of an antenna pattern is not more than 120% of the outside diameter area of the second antenna coil.

An electronic device according to the present invention has a built-in antenna module including a first antenna coil and configured to communicate by inductive coupling with a second antenna coil provided outside, in which the first antenna coil has an outside diameter larger than that of the second antenna coil and is formed in such a way that the area of an opening portion inside the innermost perimeter of an antenna pattern is not more than 120% of the outside diameter area of the second antenna coil.

An antenna module according to the present invention includes a first antenna coil and is configured to communicate by inductive coupling with a second antenna coil provided outside, in which the first antenna coil has: a larger diameter antenna portion in which an antenna pattern is wound in a plurality of turns; and a smaller diameter antenna portion provided on the inner perimeter side of the larger diameter antenna portion via a pitch larger than a pitch of the antenna pattern of the larger diameter antenna portion, and the smaller diameter antenna portion is connected in series or in parallel to the larger diameter antenna portion and configured with an antenna pattern wound in one turn.

A wireless communication system according to the present invention includes: a first antenna module including a first antenna coil; and a second antenna module including a second antenna coil and capable of communication by receiving a magnetic field transmitted from the first antenna module, in which the first antenna coil and the second antenna coil have mutually different outside diameters, and, out of the first and second antenna coils, an antenna coil having a larger outside diameter has: a larger diameter antenna portion in which an antenna pattern is wound in a plurality of turns; and a smaller diameter antenna portion provided on the inner perimeter side of the larger diameter antenna portion via a pitch larger than a pitch of the antenna pattern of the larger diameter antenna portion, and the smaller diameter antenna portion is connected in series or in parallel to the larger diameter antenna portion and configured with an antenna pattern wound in one turn.

An electronic device according to the present invention has a built-in antenna module including a first antenna coil and configured to communicate by inductive coupling with a second antenna coil provided outside, in which the first antenna coil has: a larger diameter antenna portion in which an antenna pattern is wound in a plurality of turns; and a smaller diameter antenna portion provided on the inner perimeter side of the larger diameter antenna portion via a pitch larger than a pitch of the antenna pattern of the larger diameter antenna portion, and the smaller diameter antenna portion is connected in series or in parallel to the larger diameter antenna portion and configured with an antenna pattern wound in one turn.

An antenna module according to the present invention includes a first antenna coil and is configured to communicate by inductive coupling with a second antenna coil provided outside, in which the first antenna coil has: a larger diameter antenna portion in which an antenna pattern is wound in a plurality of turns; and a smaller diameter antenna portion provided on the inner perimeter side of the larger diameter antenna portion via a pitch larger than a pitch of the antenna pattern of the larger diameter antenna portion, and the smaller diameter antenna portion is connected in series or in parallel to the larger diameter antenna portion and configured with an antenna pattern wound in a plurality of turns.

A wireless communication system according to the present invention includes: a first antenna module including a first antenna coil; and a second antenna module including a second antenna coil and capable of communication by receiving a magnetic field transmitted from the first antenna module, in which the first antenna coil and the second antenna coil have mutually different outside diameters, and, out of the first and second antenna coils, an antenna coil having a larger outside diameter has: a larger diameter antenna portion in which an antenna pattern is wound in a plurality of turns; and a smaller diameter antenna portion provided on the inner perimeter side of the larger diameter antenna portion via a pitch larger than a pitch of the antenna pattern of the larger diameter antenna portion, and the smaller diameter antenna portion is connected in series or in parallel to the larger diameter antenna portion and configured with an antenna pattern wound in a plurality of turns.

An electronic device according to the present invention has a built-in antenna module including a first antenna coil and configured to communicate by inductive coupling with a second antenna coil provided outside, in which the first antenna coil has: a larger diameter antenna portion in which an antenna pattern is wound in a plurality of turns; and a smaller diameter antenna portion provided on the inner perimeter side of the larger diameter antenna portion via a pitch larger than a pitch of the antenna pattern of the larger diameter antenna portion, and the smaller diameter antenna portion is connected in series or in parallel to the larger diameter antenna portion and configured with an antenna pattern wound in a plurality of turns.

According to the present invention, one antenna coil having a larger outside diameter is formed in such a way that the area of an opening portion inside the innermost perimeter of an antenna pattern is not more than 120% of the outside diameter area of the other antenna coil having a smaller outside diameter. Thus, when the first and second antenna modules are made to come into intimate contact with each other, the one antenna coil having a larger outside diameter is adjacent to or overlaid with the other antenna coil having a smaller outside diameter, and accordingly can achieve excellent communication characteristics with the other antenna coil having a smaller outside diameter.

BRIEF DESCRIPTION OF THE DRAWINGS

FIG. 20A illustrates a state in which the difference in outside-and-inside diameter between antenna coils is small, whereby communication can be established, on the other hand, FIG. 20B illustrates a state in which the difference in outside-and-inside diameter between antenna coils is large, whereby communication cannot be established.

DETAILED DESCRIPTION OF THE INVENTION

Figure 1:
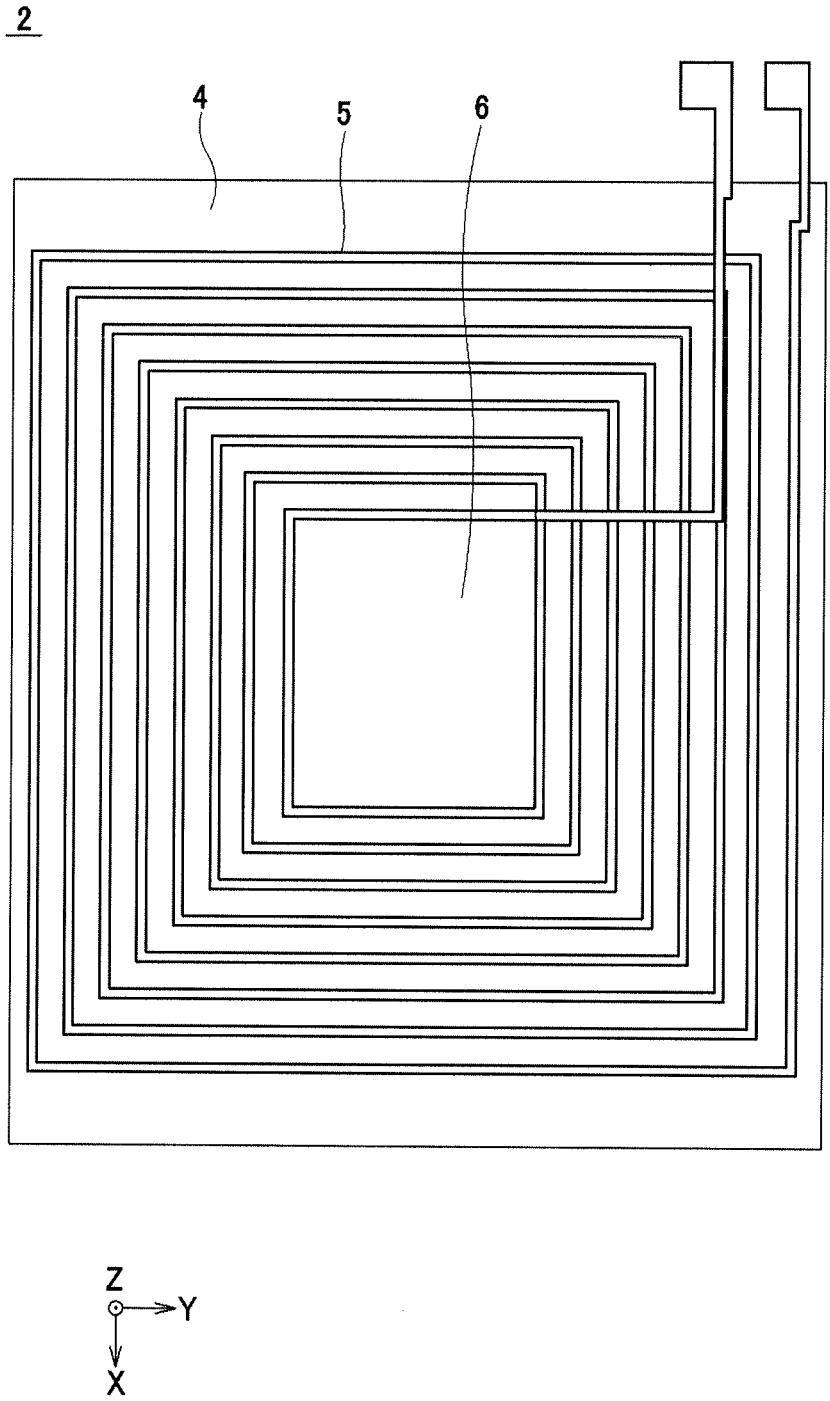
FIG. 1 is a plan view illustrating an antenna module to which the present invention is applied.

Hereinafter, a wireless communication system, an antenna module, and an electronic device each to which the present invention is applied will be described in detail with reference to the drawings. It should be noted that the present invention is not limited only to the following embodiment, and it is a matter of course that various modifications can be made within the scope not deviating from the gist of the present invention. Moreover, the drawings are schematic and the ratio of each dimension and the like in the drawings may be different from the actual ratio thereof. Specific dimensions and the like should be determined in consideration of the following description. Furthermore, it is a matter of course that the different drawings may have mutually different dimension relationships or different dimension ratios.

[Wireless Communication System]

The wireless communication system to which the present invention is applied is configured to perform short-distance wireless communication by making use of electromagnetic induction between an antenna module 2 incorporated in a portable electronic device, such as a cellular phone or a tablet terminal, and an antenna module incorporated in an external device provided outside the electronic device. In the short-distance wireless communication system making use of electromagnetic induction, communication is performed between an antenna module on a reader/writer side and an antenna module on the side of a transponder which is driven by a current generated by receiving a magnetic field transmitted from the reader/writer.

The antenna module 2 incorporated in a portable electronic device is driven as a reader/writer by receiving a supply of electric power from a built-in battery, and performs short-distance wireless communication with a small antenna module built in an IC tag provided outside. Furthermore, the antenna module 2 incorporated in the portable electronic device also functions as a transponder, and, when receiving a magnetic field from the reader/writer provided outside, the antenna module 2 is inductively coupled to a reader/writer and supplies a signal to a memory module serving as a storage medium of the portable electronic device.

Specifically, as illustrated in FIG. 1, the antenna module 2 is a module for RFID such as NFC, and includes: a sheet-shaped magnetic sheet 4 formed of a magnetic material; and a spiral-coil-shaped antenna coil 5 provided on the magnetic sheet 4 and wound in a planar fashion.

Figure 2:
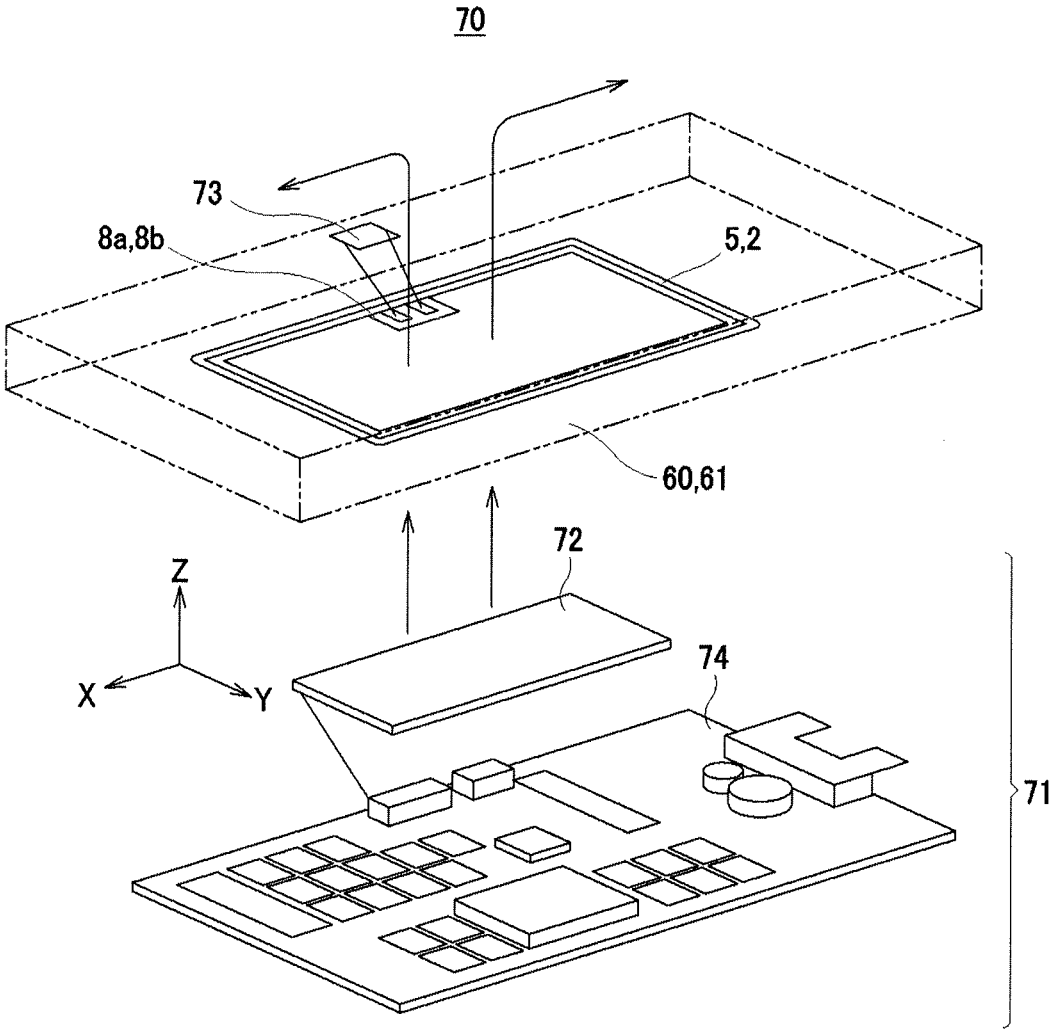
FIG. 2 is a conceptual diagram illustrating a wireless communication system.

First, a short-distance wireless communication function of the antenna module 2 will be described. For example, as illustrated in FIG. 2, the antenna module 2 is incorporated, for example, inside a casing 61 of a cellular phone 60, and used for a wireless communication system 70 for RFID.

The wireless communication system 70 is configured such that a reader/writer 71 makes access to a memory module 73 incorporated in the cellular phone 60 together with the antenna module 2. Here, the antenna module 2 and the reader/writer 71 are arranged so as to face each other in the XY-plane of a three-dimensional rectangular coordinate system XYZ.

The reader/writer 71 functions as a transmitter to transmit a magnetic field in the Z-axis direction to an antenna coil 5 of the antenna module 2 facing the reader/writer 71 in the XY-plane, and specifically, the reader/writer 71 includes: an antenna 72 configured to transmit a magnetic field to the antenna coil 5; and a control substrate 74 configured to communicate with the memory module 73.

In other words, the reader/writer 71 is provided with the control substrate 74 electrically connected to the antenna 72. On the control substrate 74, a control circuit including one or a plurality of electronic parts, such as an integrated circuit chip, is mounted. This control circuit performs various kinds of processing, based on data received from the memory module 73 via the antenna coil 5. For example, when the control circuit transmits data to the memory module 73, the control circuit encodes the data, modulates a carrier wave having a predetermined frequency (for example, 13.56 MHz) based on the encoded data, amplifies a modulated modulation signal, and drives the antenna 72 with the amplified modulation signal. Furthermore, when the control circuit reads out data from the memory module 73, the control circuit amplifies a data modulation signal received by the antenna 72, demodulates the amplified data modulation signal, and decodes the demodulated data. It should be rioted that, in the control circuit, there have been employed an encoding technique and a modulation technique which are used in common reader/writers, for example, Manchester encoding and ASK (Amplitude Shift Keying) modulation have been employed.

The antenna module 2 is configured such that the antenna coil 5 receives a magnetic field transmitted from the reader/writer 71, thereby being inductively coupled to the reader/writer 71, and supplies a signal to the memory module 73 serving as a storage medium incorporated in the cellular phone 60.

When receiving a magnetic field transmitted from the reader/writer 71, the antenna coil 5 is magnetically coupled to the reader/writer 71 by inductive coupling, receives a modulated electromagnetic wave, and supplies a received signal to the memory module 73 via terminal portions 8*a* and 8*b*.

The memory module 73 is configured to be driven by current flowing into the antenna coil 5 and communicate with the reader/writer 71. Specifically, the memory module 73 demodulates a received modulation signal, decodes demodulated data, and writes the decoded data into an internal memory of the memory module 73. Furthermore, from the internal memory, the memory module 73 reads data to be transmitted to the reader/writer 71, encodes the read data, modulates a carrier wave based on the encoded data, and transmits a modulated electric wave to the reader/writer 71 via the antenna coil 5 magnetically coupled to the reader/writer 71 by inductive coupling.

[Reader/Writer Function]

Furthermore, the antenna module 2 functions also as a reader/writer, and, for example, when the cellular phone 60 is held toward a poster or an electric device provided with an IC tag, the antenna module 2 acquires information of the poster (a coupon, a map, campaign guide, and the like), or acquires information of the electric device (electric power consumption, various settings, and the like) or performs a change of the settings. In this case, when supplied with electric power from a battery pack 81 built in the cellular phone 60, the antenna module 2 functions as a reader/writer. Short-distance wireless communication between the antenna module 2 as a reader/writer and an IC tag is performed in the same manner as in the foregoing communication between the reader/writer 71 and the antenna module 2.

[Antenna Module]

Next, a configuration of the antenna module 2 used for such short-distance wireless communication system 1 will be described. As mentioned above, the antenna module 2 includes: a sheet-shaped magnetic sheet 4 formed of a magnetic material; and a spiral-coil-shaped antenna coil 5 provided on the magnetic sheet 4 and wound in a planar fashion (see FIG. 1).

The magnetic sheet 4 is made of, for example, a NiZn ferrite sintered compact. The magnetic sheet 4 is formed in such a manner that ferrite particles are applied in advance in the form of a sheet and sintered under high temperature, and then, cut with a die so as to have a predetermined shape. Alternatively, the magnetic sheet 4 can be formed also in such a manner that ferrite particles are applied in advance in the form of a sheet so as to have the same shape as a final shape, and sintered. Alternatively, the magnetic sheet 4 can be formed also in such a manner that ferrite particles are filled in a mold having a rectangular cross-section and sintered to be made into a rectangular parallelepiped having a rectangular shape in the plane view, and a thus-obtained sintered compact is thinly sliced to obtain a determined shape.

It should be noted that the magnetic sheet 4 may contain magnetic particles made of a soft magnetic powder and a resin as a binding material.

Furthermore, as the magnetic particles, there may be used particles of an oxide magnetic material such as ferrite; Fe-based, Co-based, Ni-based, Fe—Ni-based, Fe—Co-based, Fe—Al-based, Fe—Si-based, Fe—Si—Al-based, Fe—Ni—Si—Al-based or the like crystalline or microcrystalline magnetic material such as sendust or permalloy, or an Fe—Si—B, Fe—Si—B—C, Co—Si—B, Co—Zr, Co—Nb, Co—Ta, or the like amorphous metal magnetic material.

Particularly, Ni—Zn-based ferrite mentioned above as a magnetic material is suitably used for the magnetic sheet 4 to be used for the antenna module 2 for RFID such as NFC.

A resin and the like cured by heat, ultraviolet exposure, or the like may be used as a binding material. As the binding material, there may be used well-known materials, for example, resins such as an epoxy resin, a phenol resin, a melamine resin, a urea resin and an unsaturated polyester resin, or rubbers such as a silicone rubber, a urethane rubber, an acrylic rubber, a butyl rubber and an ethylene propylene rubber. It should be noted that the binding material may be formed by adding an appropriate amount of a surface treatment agent, such as a flame retardant, a reaction regulator, a crosslinking agent, or a silane coupling agent, to the foregoing resins or rubbers.

It should be noted that the magnetic sheet 4 is not limited to be formed of a single magnetic material, but also may be formed by using two or more kinds of magnetic materials mixed, or may be formed by laminating two or more kinds of magnetic materials in a multilayer form. Furthermore, the magnetic sheet 4 may be formed of a single type of a magnetic material, or may be formed by selecting plural types of particle diameters and/or forms of magnetic particles and mixing or by laminating such magnetic particles in a multilayer.

[Antenna Coil]

The antenna coil 5 is such that an electric conductive pattern made of Cu foil or the like is formed in the shape of a spiral coil on a flexible substrate made of polyimide or the like. The antenna coil 5 is formed so as to have an approximately rectangular, a circular, or an elliptical external shape. Hereinafter, descriptions will be given using an antenna coil 5 formed in an approximately rectangular shape as an example.

The antenna coil 5 is formed in such a way that the width of an antenna pattern and/or the pitch of the antenna pattern are expanded, whereby the area of an opening portion 6 inside the innermost perimeter of the antenna pattern is not more than 120% of the outside diameter area of an antenna coil 20 of a small antenna module provided in an IC tag.

[Effects of Action]

Here, the antenna coil provided in the IC tag is smaller than the antenna coil 5 of the antenna module 2 built in the cellular phone 60. For example, the antenna coil 2 has an outside diameter of 60 mm×50 mm, on the other hand, the small antenna coil built in the IC tag or the like in NFC standards has an outside diameter of 20 mm×25 mm.

Figure 4:
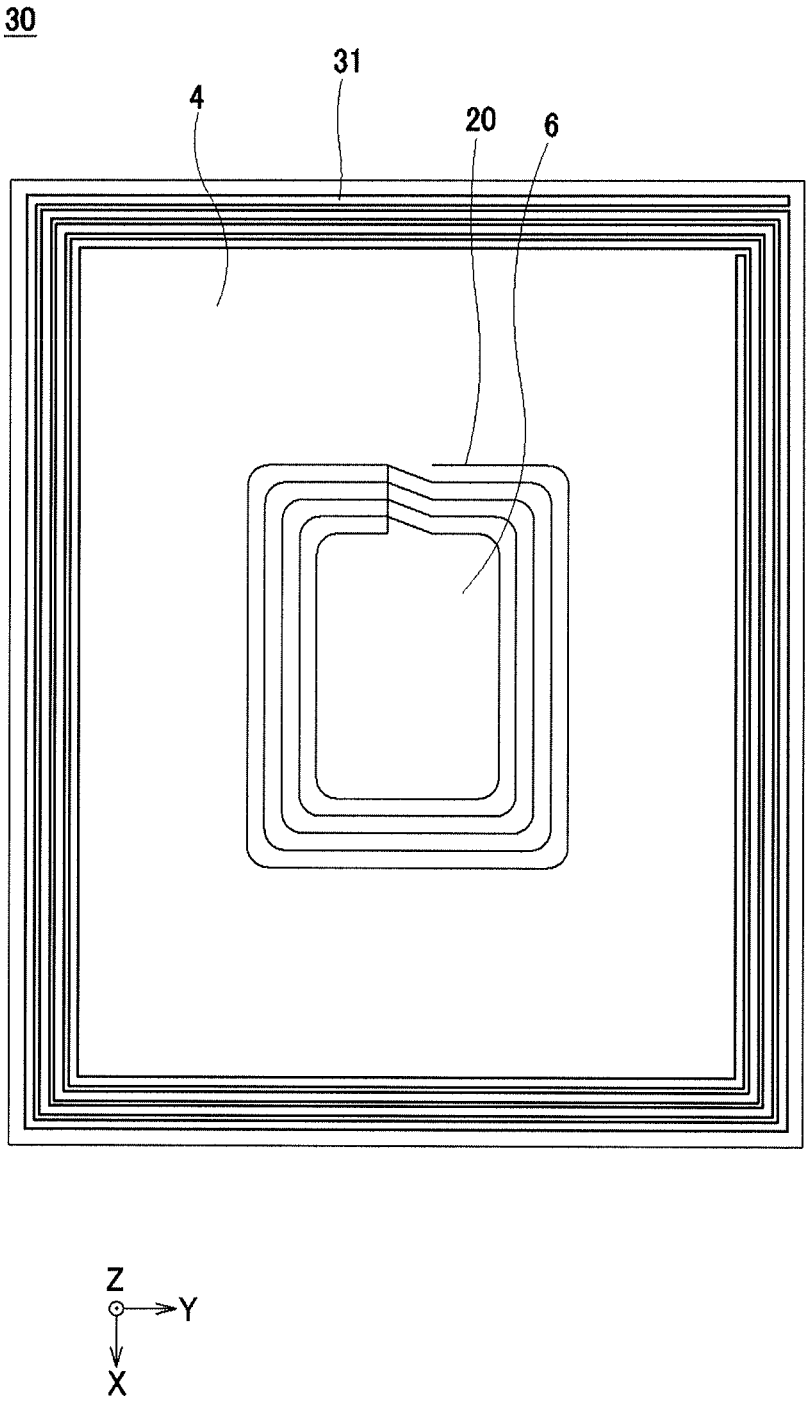
FIG. 4 is a plan view illustrating a conventional antenna module together with a smaller antenna coil at the other end of communication.
Figure 20A:
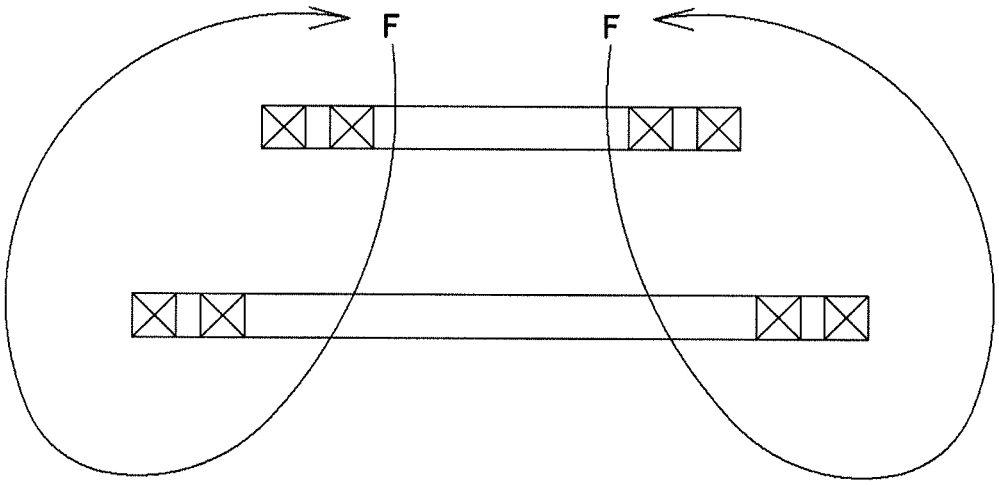
FIG. 20A and FIG. 20B are to explain the communication performances of antenna coils having different outside and inside diameters.
Figure 20B:
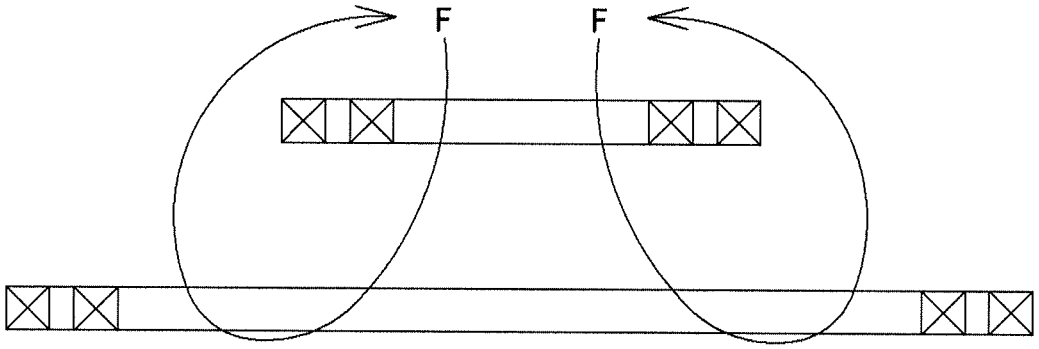

As mentioned above, a magnetic field transmitted from the antenna module on the cellular phone side has a higher magnetic flux density at a point closer to an antenna coil, on the other hand, has a lower magnetic flux density at a point farther from the antenna coil. The same goes for a magnetic field transmitted from the antenna module on the IC tag side. Short-distance wireless communication is performed in such a manner that the cellular phone 60 is held toward the IC tag, whereby the antenna module 2 and the antenna coil on the IC tag side are made to come into intimate contact with each other to the extent that the distance between the antenna module 2 and the antenna coil reaches several millimeters. Therefore, as illustrated in FIG. 4, in a case where the difference between the inside diameter of the antenna coil 5 and the outside diameter of the small antenna coil 20 on the IC tag side, the antenna coils 5 and 20 communicating with each other, is larger, there is a risk that a magnetic flux transmitted from one of the antenna coils does not reach the other, whereby an inductive coupling cannot be achieved (see FIG. 20).

Figure 3:
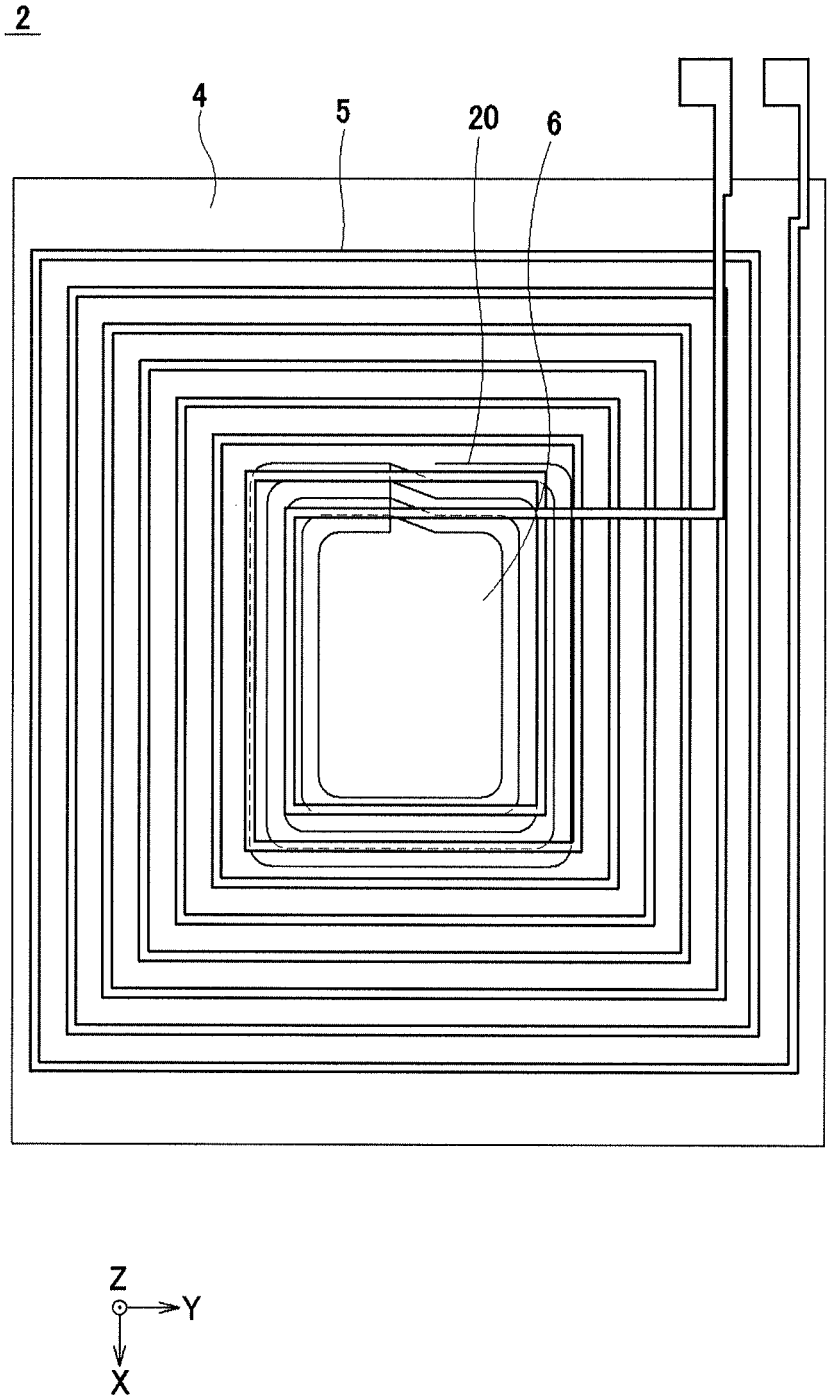
FIG. 3 is a plan view illustrating an antenna module to which the present invention is applied together with a smaller antenna coil at the other end of communication.

Hence, the antenna module 2 on the cellular phone 60 side is formed in such a way that the area of the opening portion 6 inside the innermost perimeter of the antenna pattern is not more than 120% of the outside diameter area of the antenna coil of the small antenna module provided in an IC tag. Thus, as illustrated in FIG. 3, when the cellular phone 60 is held toward the IC tag, the antenna coil 5 is adjacent to or overlaid with the small antenna coil 20 of the antenna module on the IC tag side, and accordingly can also communicate with the small antenna coil 20.

[Antenna Pattern]

In the antenna coil 5, the line width of an antenna pattern and/or the pitch of the antenna pattern are uniformly expanded over the entire perimeter, whereby the area of the opening portion 6 can be adjusted. FIG. 1 illustrates that the area of the opening portion 6 is adjusted not by changing the line width of the antenna pattern of an antenna coil 31 in a conventional antenna module 30 illustrated in FIG. 4, but by expanding the pitch of the antenna pattern thereof. It should be noted that, in the antenna coil 5, the area of the opening portion 6 may be adjusted by expanding the line width and the pitch of the antenna pattern of the antenna coil 31 in the conventional antenna module 30 (FIG. 4).

[Larger Diameter Antenna Portion 5*a*/Smaller Diameter Antenna Portion 5*b*]

Figure 5:
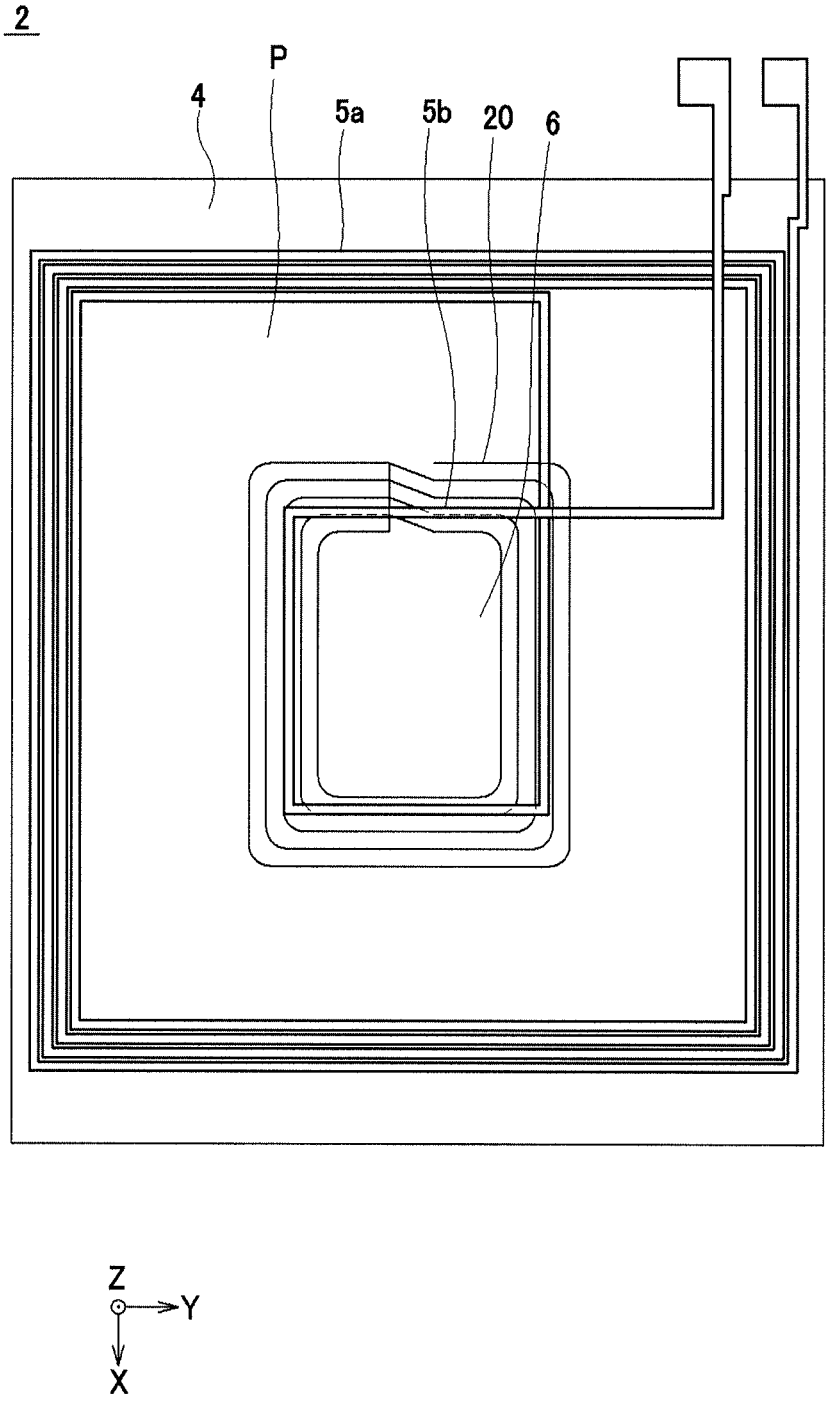
FIG. 5 is a plan view illustrating another antenna module to which the present invention is applied together with a smaller antenna coil at the other end of communication.
Figure 6:
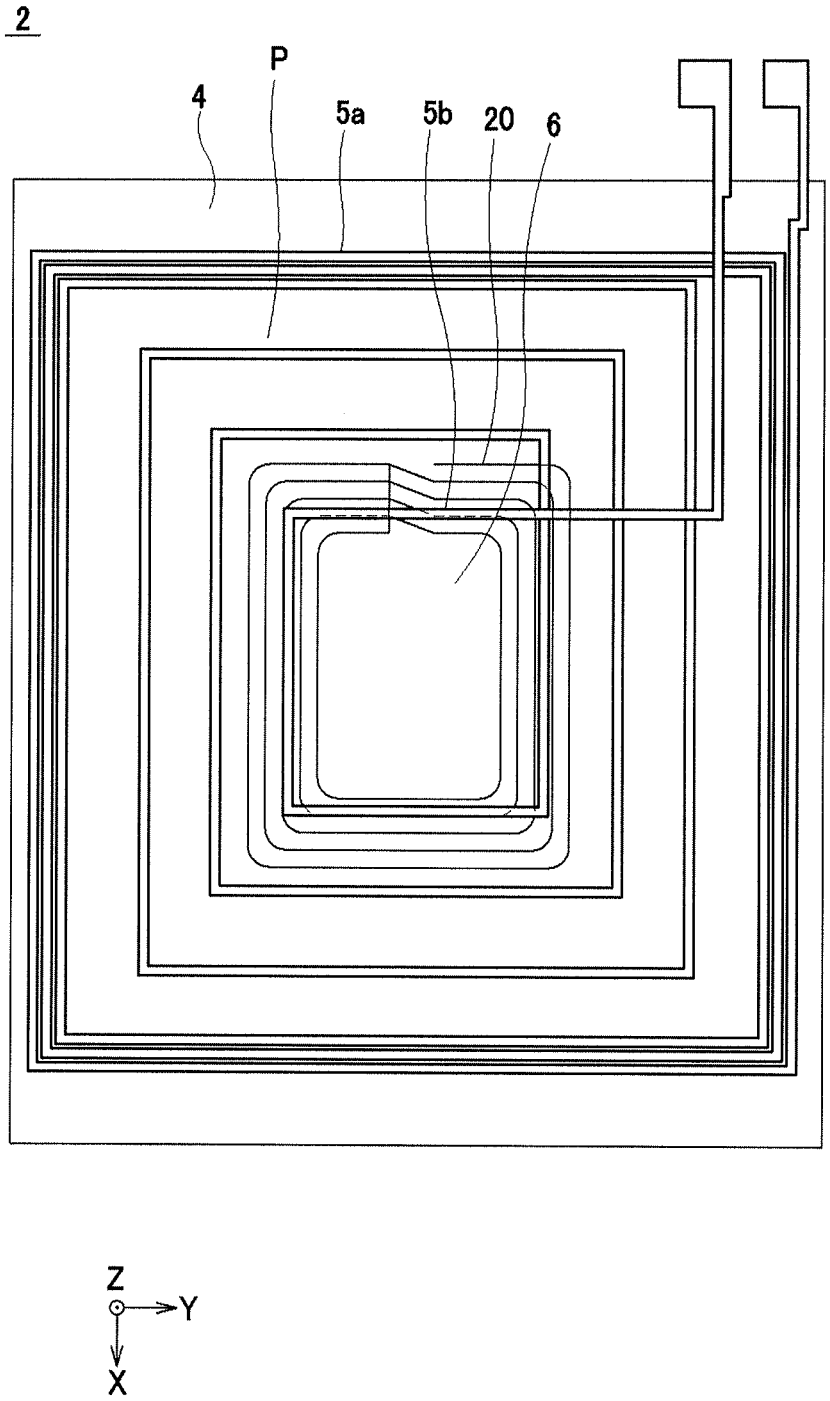
FIG. 6 is a plan view illustrating another antenna module to which the present invention is applied together with a smaller antenna coil at the other end of communication.

As illustrated in FIG. 5 and FIG. 6, the antenna coil 5 may have: a larger diameter antenna portion 5*a* in which an antenna pattern is wound in a plurality of turns; and a smaller diameter antenna portion 5*b* provided on the inner perimeter side of the larger diameter antenna portion 5*a* via a pitch larger than a pitch of the antenna pattern of the larger diameter antenna portion 5*a*.

As is the case with the conventional antenna coil 31, in the larger diameter antenna portion 5*a*, an antenna pattern is wound in a plurality of turns along the outer side edge of the magnetic sheet 4. The larger diameter antenna portion 5*a* is dedicated to communication with a reader/writer provided outside when the antenna module 2 functions as a transponder which is driven by receiving a magnetic field from the reader/writer.

The smaller diameter antenna portion 5*b* is provided inside the larger diameter antenna portion 5*a*, and a pitch P larger than a pitch of the antenna pattern of the larger diameter antenna portion 5*a* is interposed between the larger diameter antenna portion 5*a* and the smaller diameter antenna portions 5*b*.

The smaller diameter antenna portion 5*b* is dedicated to communication with the small antenna coil 20 built in an IC tag or the like provided outside when the antenna module 2 functions as a reader/writer. The smaller diameter antenna portion 5*b* is formed in such a way that the area of the opening portion 6 inside the innermost perimeter of the antenna pattern is not more than 120% of the outside diameter area of the small antenna coil 20.

In the antenna module 2 illustrated in FIG. 5, the smaller diameter antenna portion 5*b* is connected in series to the larger diameter antenna portion 5*a*, and an antenna pattern of the smaller diameter antenna portion 5*b* is wound in one turn, whereby an opening portion 6 narrower than the outside diameter of the small antenna coil 20 is formed.

In the antenna module 2 illustrated in FIG. 6, the smaller diameter antenna portion 5*b* is connected in series to the larger diameter antenna portion 5*a*, and an antenna pattern of the smaller diameter antenna portion 5*b* is wound in a plurality of turns, whereby an opening portion 6 narrower than the outside diameter of the small antenna coil 20 is formed. In the smaller diameter antenna portion 5*b* illustrated in FIG. 6, the antenna pattern is formed with a pattern pitch larger than a pattern pitch of the larger diameter antenna portion 5*a*.

Figure 7:
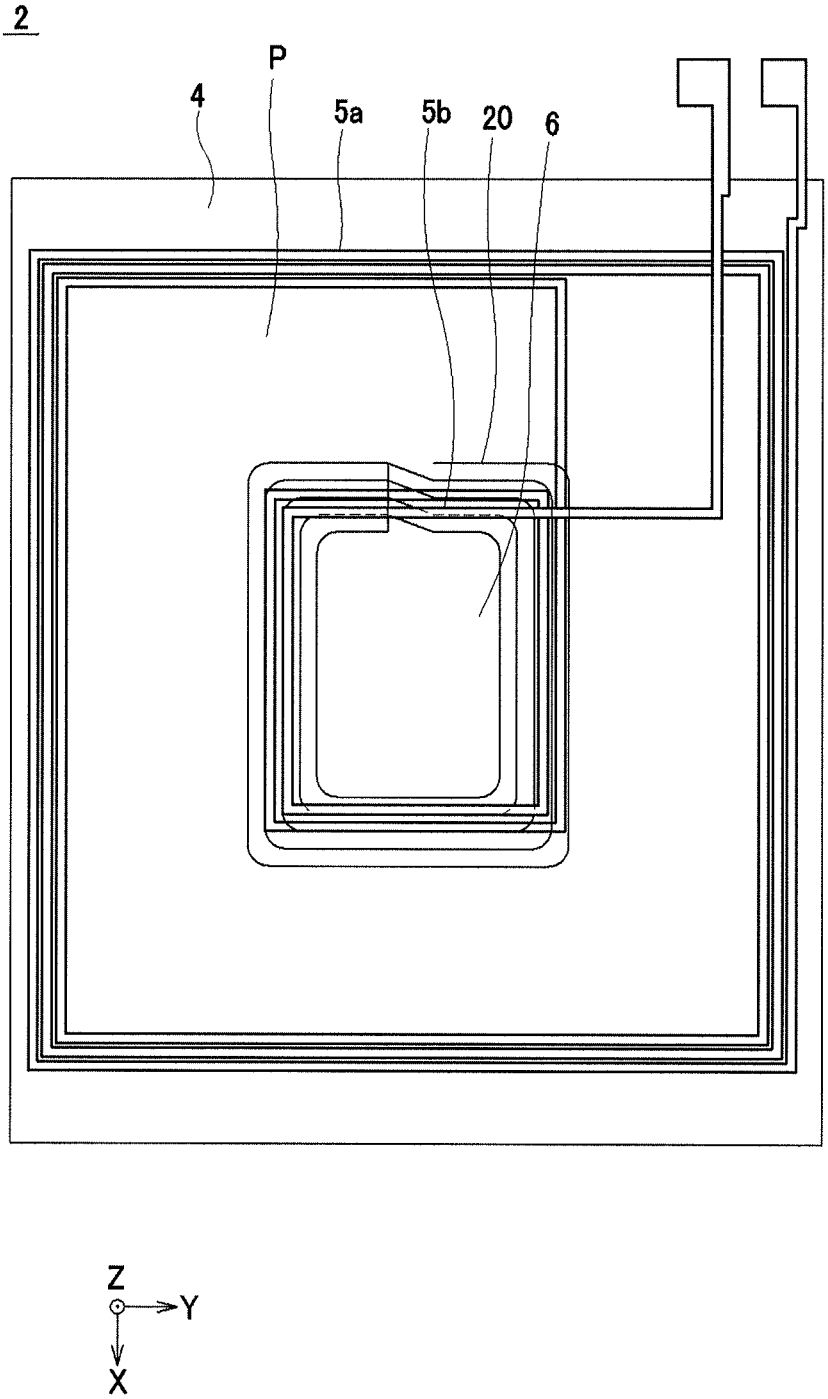
FIG. 7 is a plan view illustrating another antenna module to which the present invention is applied together with a smaller antenna coil at the other end of communication.
Figure 8:
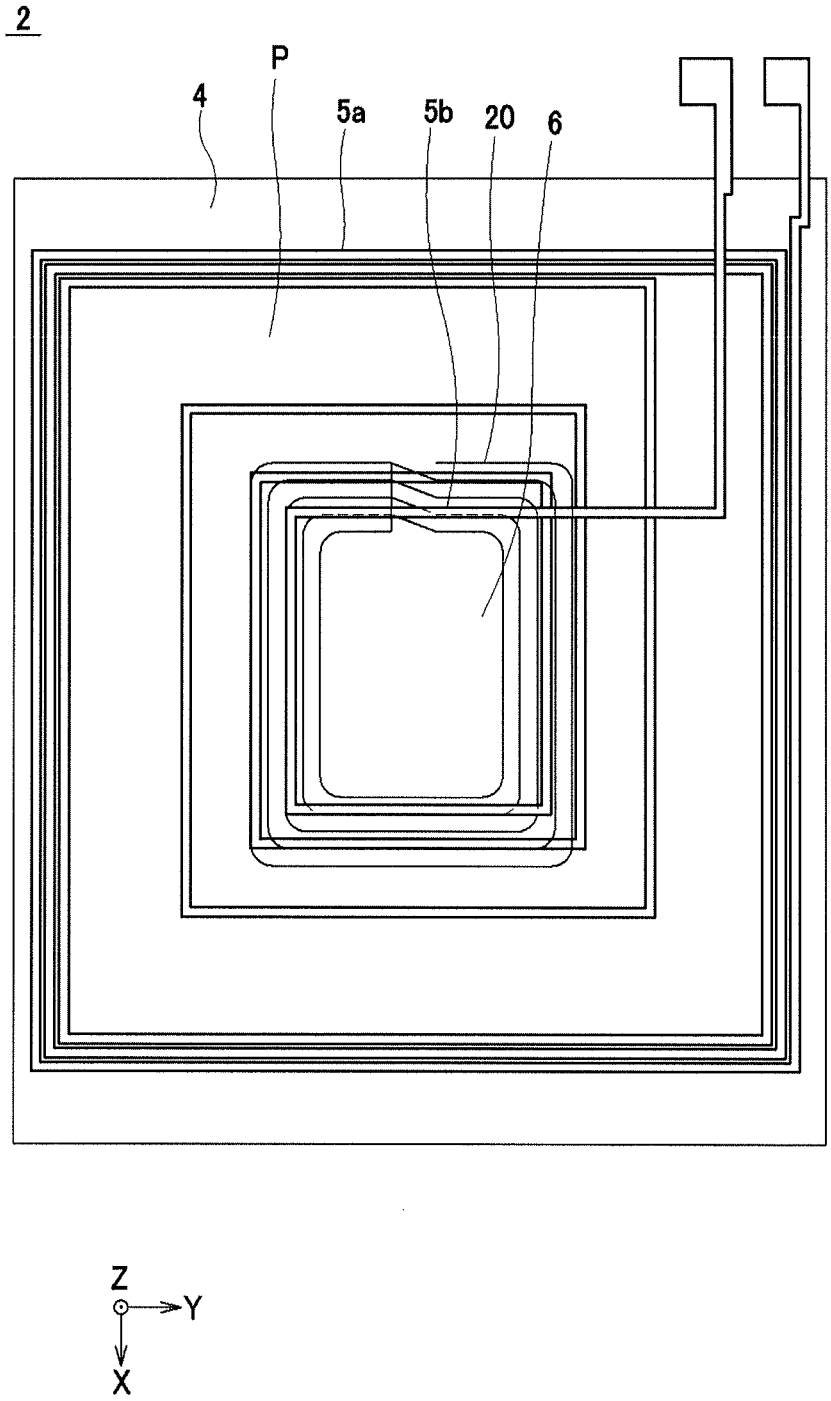
FIG. 8 is a plan view illustrating another antenna module to which the present invention is applied together with a smaller antenna coil at the other end of communication.

It should be noted that, as illustrated in FIG. 7, in the smaller diameter antenna portion 5*b*, the antenna pattern may be wound in a plurality of turns with the same pattern pitch as a pattern pitch of the larger diameter antenna portion 5*a*. Alternatively, as illustrated in FIG. 8, in the smaller diameter antenna portion 5*b*, the antenna pattern may be wound in a plurality of turns with different pitches every turn.

Alternatively, the larger diameter antenna portion 5*a* and the smaller diameter antenna portion 5*b* may be connected in series as illustrated in FIG. 5 and FIG. 6, or may be connected in parallel.

[Magnetic Sheet]

The magnetic sheet 4 has an outside diameter not smaller than the outside diameter of the antenna coil 5, and is stuck onto a flexible substrate in which the antenna coil 5 is formed, whereby the magnetic sheet 4 is overlaid with the entire region of the antenna coil 5.

Figure 9:
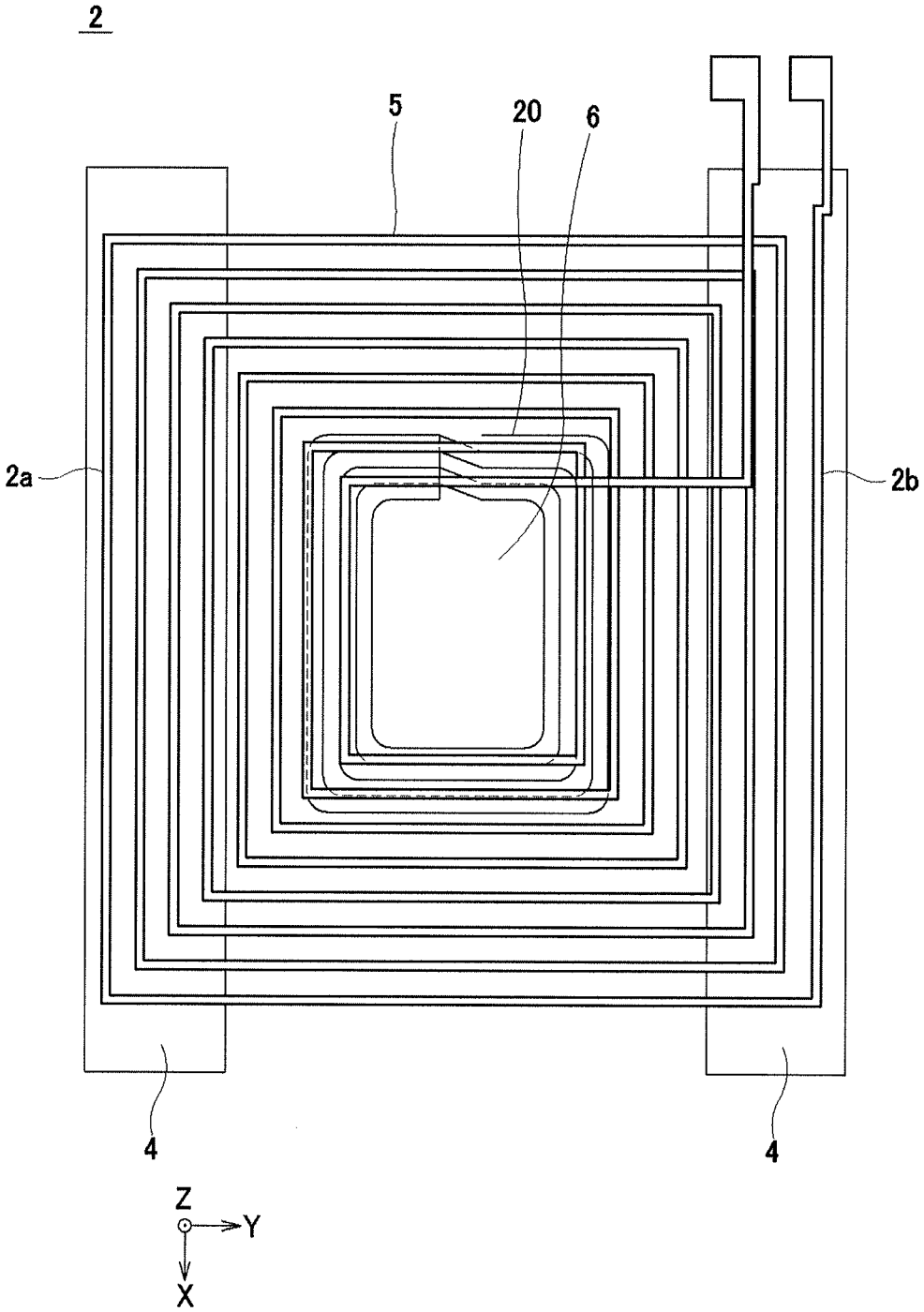
FIG. 9 is a plan view illustrating another antenna module to which the present invention is applied together with a smaller antenna coil at the other end of communication.

It should be noted that, as illustrated in FIG. 9, in the antenna module 2, the magnetic sheet 4 may be superposed only on antenna pattern parts formed along a left side 2*a* and a right side 2*b* of the antenna module 2. This allows the magnetic sheet 4 to be made smaller, compared to the case in which the magnetic sheet 4 is overlaid with the entire region of the antenna coil 5, and thus, the amount of a magnetic material used can be considerably reduced. Furthermore, the superposition of the magnetic sheet 4 on antenna pattern parts formed along the left side 2*a* and the right side 2*b* enables efficient reception of a magnetic flux transmitted from the reader/writer provided outside, and accordingly, there are achieved communication characteristics equivalent to the case in which the magnetic sheet 4 is superposed over the entire region of the antenna coil 5.

Figure 10:
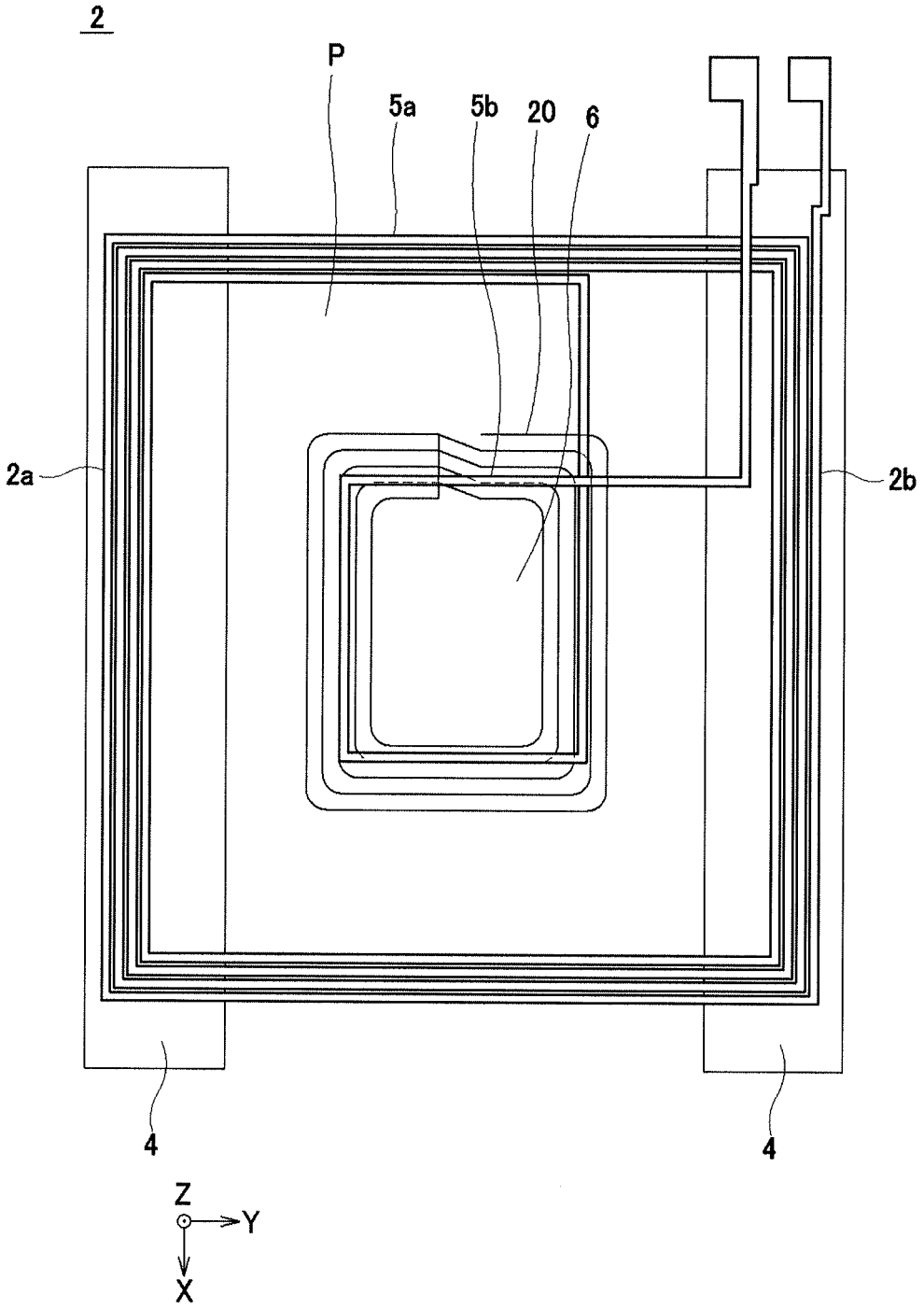
FIG. 10 is a plan view illustrating another antenna module to which the present invention is applied together with a smaller antenna coil at the other end of communication.
Figure 11:
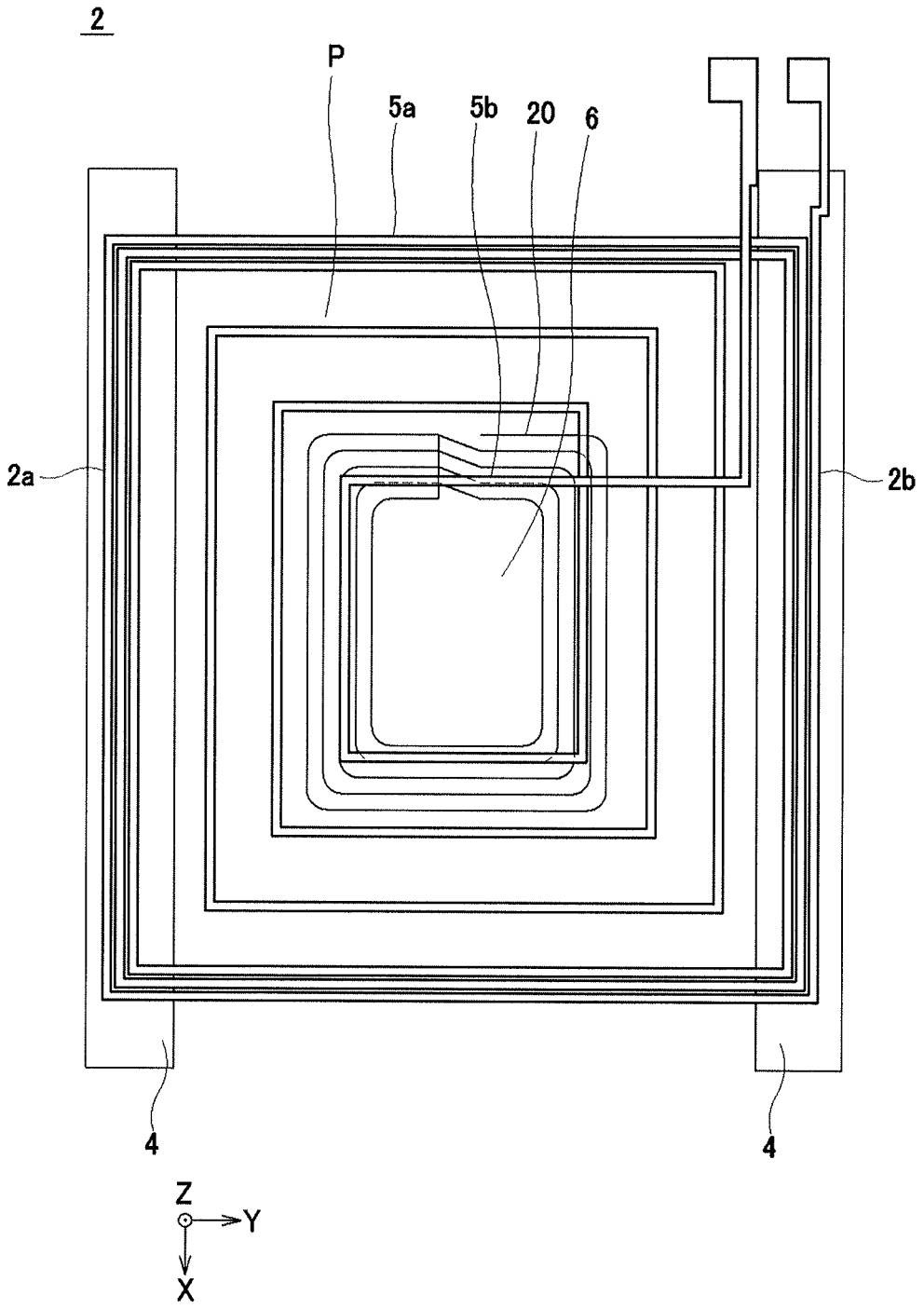
FIG. 11 is a plan view illustrating another antenna module to which the present invention is applied together with a smaller antenna coil at the other end of communication.

It should be noted that, in an antenna module having the larger diameter antenna portion 5*a* and the smaller diameter antenna portion 5*b* as the antenna coil 5, as illustrated in FIG. 10 and FIG. 11, the magnetic sheet 4 is preferably superposed only on the parts of larger diameter antenna portion 5*a*, the parts being formed along the left side 2*a* and the right side 2*b*.

<Embodiment 1>

Next, Embodiment will be described to compare each communication characteristic of the antenna modules 2 (FIG. 1, FIG. 5, FIG. 6) to which the present invention is applied and the conventional antenna module 30 (FIG. 4). In the present Embodiment, there were determined, by simulation, coupling coefficients K at the time when the antenna modules according to Examples and Comparative Example served as a reader/writer and communicated with the small antenna coil 20 provided outside.

The small antenna coil 20 has an external shape of 25 mm×20 mm and is a coil of 5 turns with a pitch of 1 mm. The distance between the small antenna coil 20 and each of the antenna coils 5 and 31 of the respective antenna modules 2 and 30 according to Examples and Comparative Example was such that the small antenna coil 20 and each of the antenna coils 5 and 31 came into intimate contact with each other.

<Comparative Example

Figure 12:
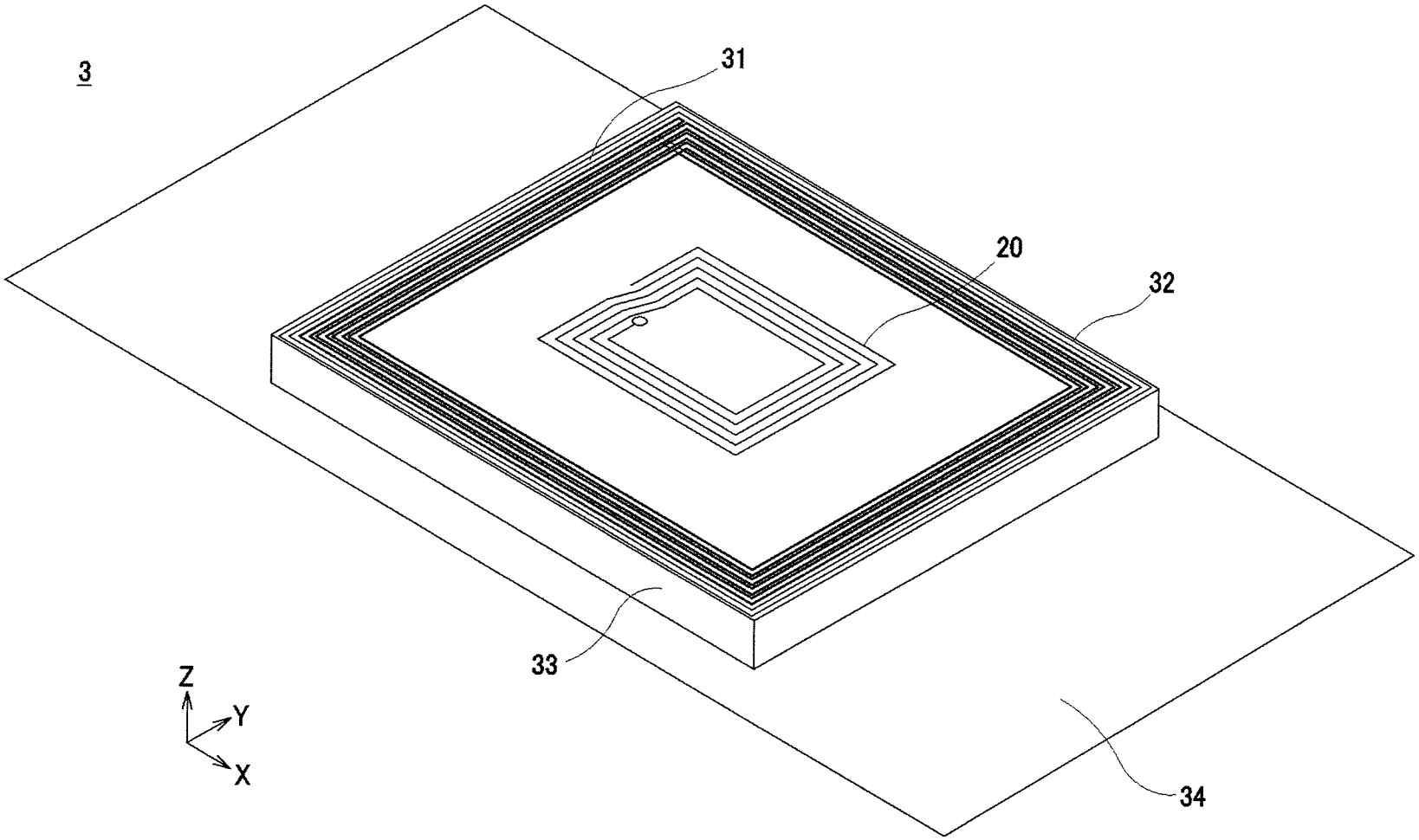
FIG. 12 is a perspective view describing Examples.

In the conventional antenna module 30 according to Comparative Example, as an antenna pattern, there is formed a coil having an external shape of 60 mm×50 mm and 4 turns with a pitch of 0.8 mm. Furthermore, as illustrated in FIG. 12, in the antenna module 30 according to Comparative Example, as a magnetic sheet, a ferrite sheet 32 having a thickness of 0.2 mm and a relative magnetic permeability of 120 is overlaid with the entire surface of the antenna coil 31. Furthermore, the conventional antenna module 30 according to Comparative Example is overlaid with an aluminum block 33 having a rectangular shape of 50 mm×60 mm×5 mm and being made to serve as a battery, and also superposed, via the aluminum block 33, on a stainless steel plate 34 having a rectangular shape of 120 mm×60 mm×0.3 mm and being made to serve as an outer casing of an electronic device. The distance between the aluminum block 33 and the antenna pattern is 0.5 mm.

The antenna coil 31 according to Comparative Example and the small antenna coil 20 were superposed in the XY-plane illustrated in FIG. 12, and there was determined a coupling coefficient K at the time when a state (off_X=0.0 mm) in which the centers of the antenna coil in FIG. 12 and the small antenna coil 20 were made to coincide with each other was changed to a state in which the small antenna coil 20 was moved in the X direction. Likewise, there was determined a coupling coefficient K at the time when a state (off_Y=0.0 mm) in which the centers of the antenna coil 31 and the small antenna coil 20 were made to coincide with each other was changed to a state in which the small antenna coil 20 was moved in the Y direction.

<Example 1>

An antenna module 2 according to Example 1 has a 53 mm×48 mm external shape similar to the small antenna coil 20 and has a coil of 8 turns with a pitch of 2.2 mm. As illustrated in FIG. 1, in the antenna module 2 according to Example 1, an antenna pattern is formed with a uniform pitch over the entire perimeter, and the area of the opening portion 6 inside the innermost perimeter of the antenna pattern is smaller than the outside diameter area of the small antenna coil 20. It should be noted that, as is the case with Comparative Example 1, in the antenna module 2 according to Example 1, the ferrite sheet 32 is overlaid with the entire surface of the antenna coil 5, and furthermore, the aluminum block 33 and the stainless steel plate 34 are superposed thereon.

Also in the antenna module 2 according to Example 1, as is the case with Comparative Example 1, the antenna coil 5 and the small antenna coil 20 were superposed in the XY-plane, and there were determined coupling coefficients K at the time when a state in which the centers of the antenna coil 5 and the small antenna coil 20 were made to coincide with each other was changed to states in which the small antenna coil 20 was moved in the X direction and the Y direction, respectively.

<Example 2>

An antenna module 2 according to Example 2 has a 53 mm×48 mm external shape similar to the small antenna coil 20, and, as illustrated in FIG. 5, in the antenna module 2, there are formed a larger diameter antenna portion 5*a* including a coil of 4 turns with a pitch of 0.8 mm and a smaller diameter antenna portion 5*b* including a coil of 1 turn and connected in series to the larger diameter antenna portion 5*a*. In the smaller diameter antenna portion 5*b* according to Example 2, the area of an opening portion 6 inside the innermost perimeter of the antenna pattern is smaller than the outside diameter area of the small antenna coil 20. It should be noted that, as is the case with Comparative Example 1, also in the antenna module 2 according to Example 2, the ferrite sheet 32 is overlaid with the entire surface of the antenna coil 5, and furthermore, the aluminum block 33 and the stainless steel plate 34 are superposed thereon.

Also in the antenna module 2 according to Example 2, as is the case with Comparative Example 1, the antenna coil 5 and the small antenna coil 20 were superposed in the XY-plane, and there were determined coupling coefficients K at the time when a state in which the centers of the antenna coil 5 and the small antenna coil 20 were made to coincide with each other was changed to states in which the small antenna coil 20 was moved in the X direction and the Y direction, respectively.

<Example 3>

An antenna module 2 according to Example 3 has a 53 mm×48 mm external shape similar to the small antenna coil 20, and, as illustrated in FIG. 6, in the antenna module 2, there are formed a larger diameter antenna portion 5*a* including a coil of 3 turns with a pitch of 0.8 mm and a smaller diameter antenna portion 5*b* including a coil of 3 turns with a pitch of 5.0 mm and connected in series to the larger diameter antenna portion 5*a*.

In the smaller diameter antenna portion 5*b* according to Example 3, the area of an opening portion 6 inside the innermost perimeter of the antenna pattern is smaller than the outside diameter area of the small antenna coil 20. It should be noted that, as is the case with Comparative Example 1, also in the antenna module 2 according to Example 3, the ferrite sheet 32 is overlaid with the entire surface of the antenna coil 5, and furthermore, the aluminum block 33 and the stainless steel plate 34 are superposed thereon.

Also in the antenna module 2 according to Example 3, as is the case with Comparative Example 1, the antenna coil 5 and the small antenna coil 20 were superposed in the XY-plane, and there were determined coupling coefficients K at the time when a state in which the centers of the antenna coil 5 and the small antenna coil 20 were made to coincide with each other was changed to states in which the small antenna coil 20 was moved in the X direction and the Y direction, respectively.

Figure 13:
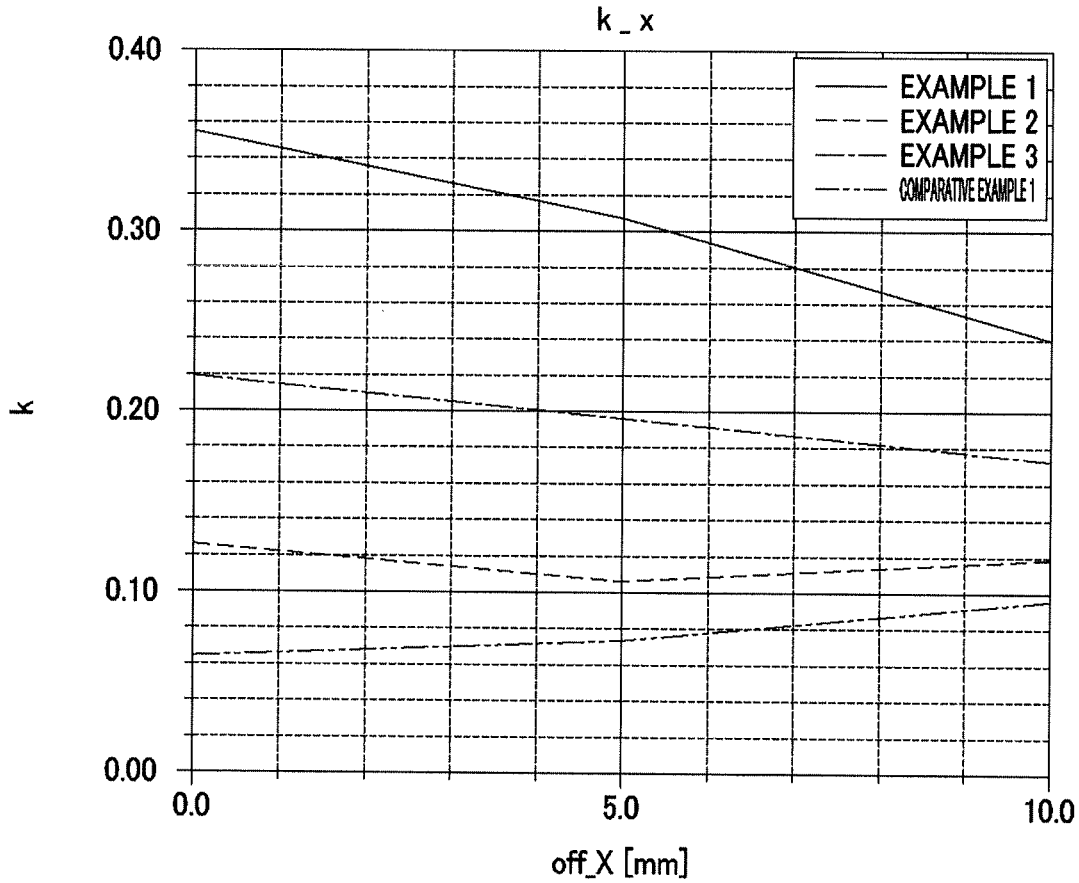
FIG. 13 is a graph showing communication characteristics between a smaller antenna coil and antenna modules according to Examples and Comparative Examples.
Figure 14:
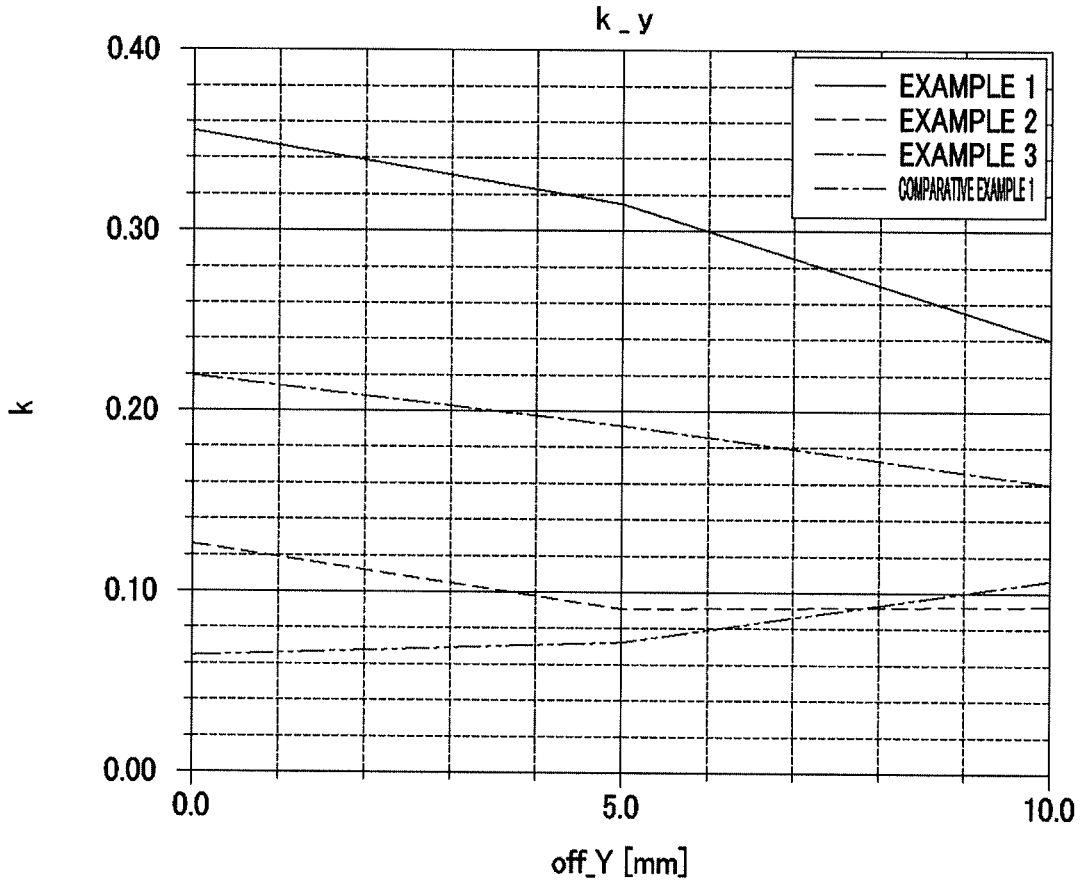
FIG. 14 is a graph showing coupling coefficients K between a smaller antenna coil and antenna modules according to Examples and Comparative Examples.

FIG. 13 shows variations in coupling coefficient K of the small antenna coil 20 and each of the antenna coils 5 and 31 according to Examples and Comparative Example when the small antenna coil 20 was moved in the X direction, and FIG. 14 shows variations in coupling coefficient K of the small antenna coil 20 and each of the antenna coils 5 and 31 according to Examples and Comparative Example when the small antenna coil 20 was moved in the Y direction.

As shown in FIG. 13 and FIG. 14, according to the antenna modules 2 of Examples, the area of the opening portion 6 inside the innermost perimeter of each of the antenna patterns is equal to or smaller than the outside diameter area of the small antenna coil 20, and thus, the difference between the diameter of the innermost perimeter of the antenna pattern and the outside diameter of the small antenna coil 20 is small, and accordingly the antenna modules 2 have excellent communication characteristics. On the other hand, according to the antenna module 30 of Comparative Example, the difference between the diameter of the innermost perimeter of the antenna pattern and the outside diameter of the small antenna coil 20 is large, and accordingly the antenna module 30 exhibits poorer communication performance.

Here, the coupling coefficient K of the small antenna coil 20 and the antenna coil 5 according to each Example is expressed by:

$$K=M/\sqrt{(L1\cdot L2)}$$

in which L1 represents a self-inductance of the antenna coil 5, L2 represents a self-inductance of the small antenna coil 20, and M represents a mutual inductance. The outside diameter of the small antenna coil 20 is constant, and hence the self-inductance L2 is accordingly constant. Therefore, a decrease in the self-inductance L1 of the antenna coil 5 according to each Example allows the coupling coefficient K to be improved. Therefore, in the antenna coil 5, a larger pitch of the antenna pattern causes a lower self-inductance L1, and hence, the configuration of Example 1 exhibits the highest coupling coefficient K.

On the other hand, in view of communication characteristics with an antenna coil having a larger diameter and incorporated in a reader/writer, the configurations of Examples 2 and 3 each having the larger diameter antenna portion 5*a* are more advantageous. Thus, the configuration of Example 3 exhibits excellent robustness against displacements between the positions of the reader/writer and the small antenna coil 20, and hence, it can be said that the configuration of Example 3 has a comparatively excellent balance of communication characteristics.

<Embodiment 2>

Figure 15:
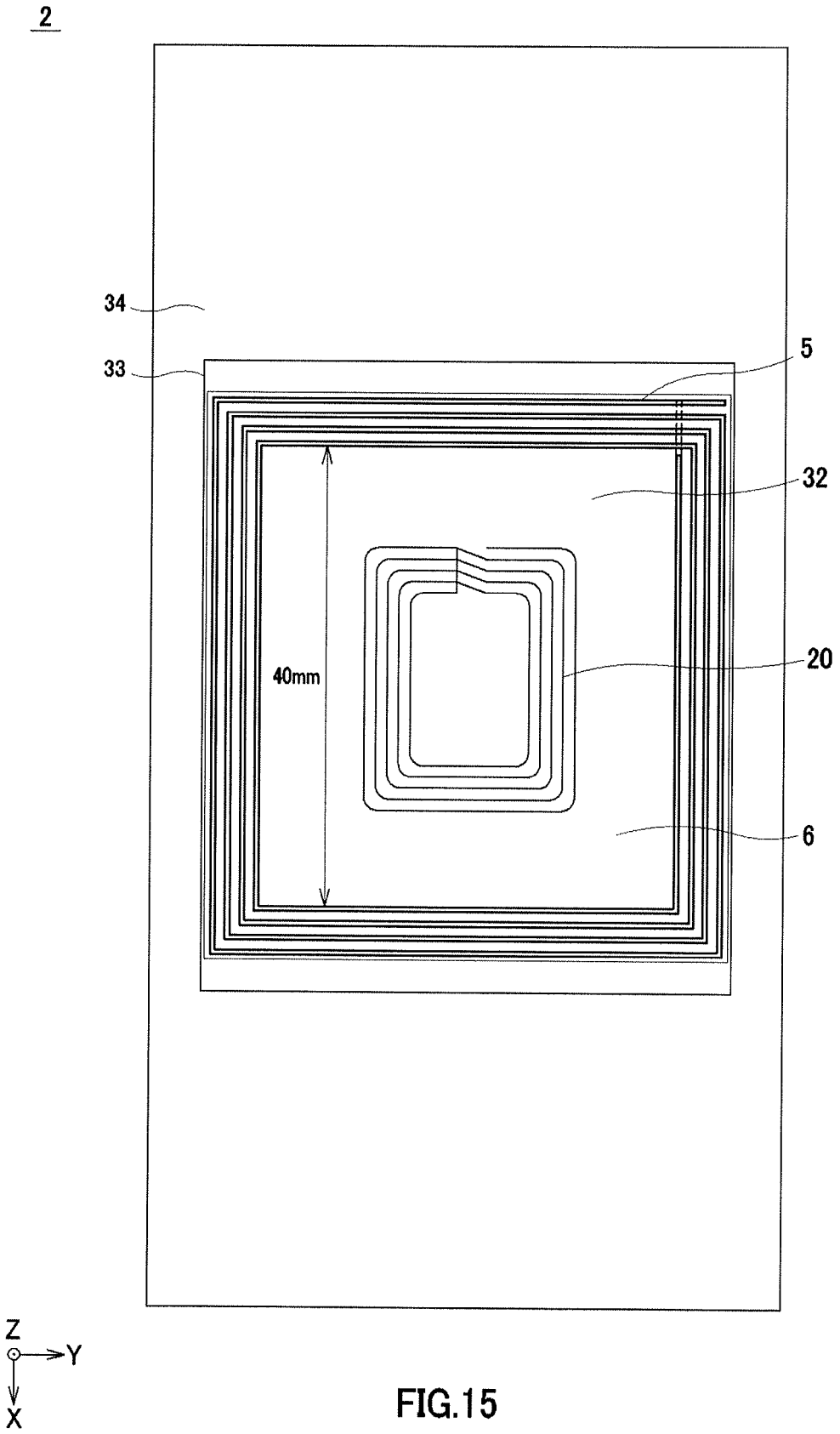
FIG. 15 is a plan view illustrating an Example in which the length of the long side of the innermost perimeter of an antenna pattern is 40 mm.
Figure 16:
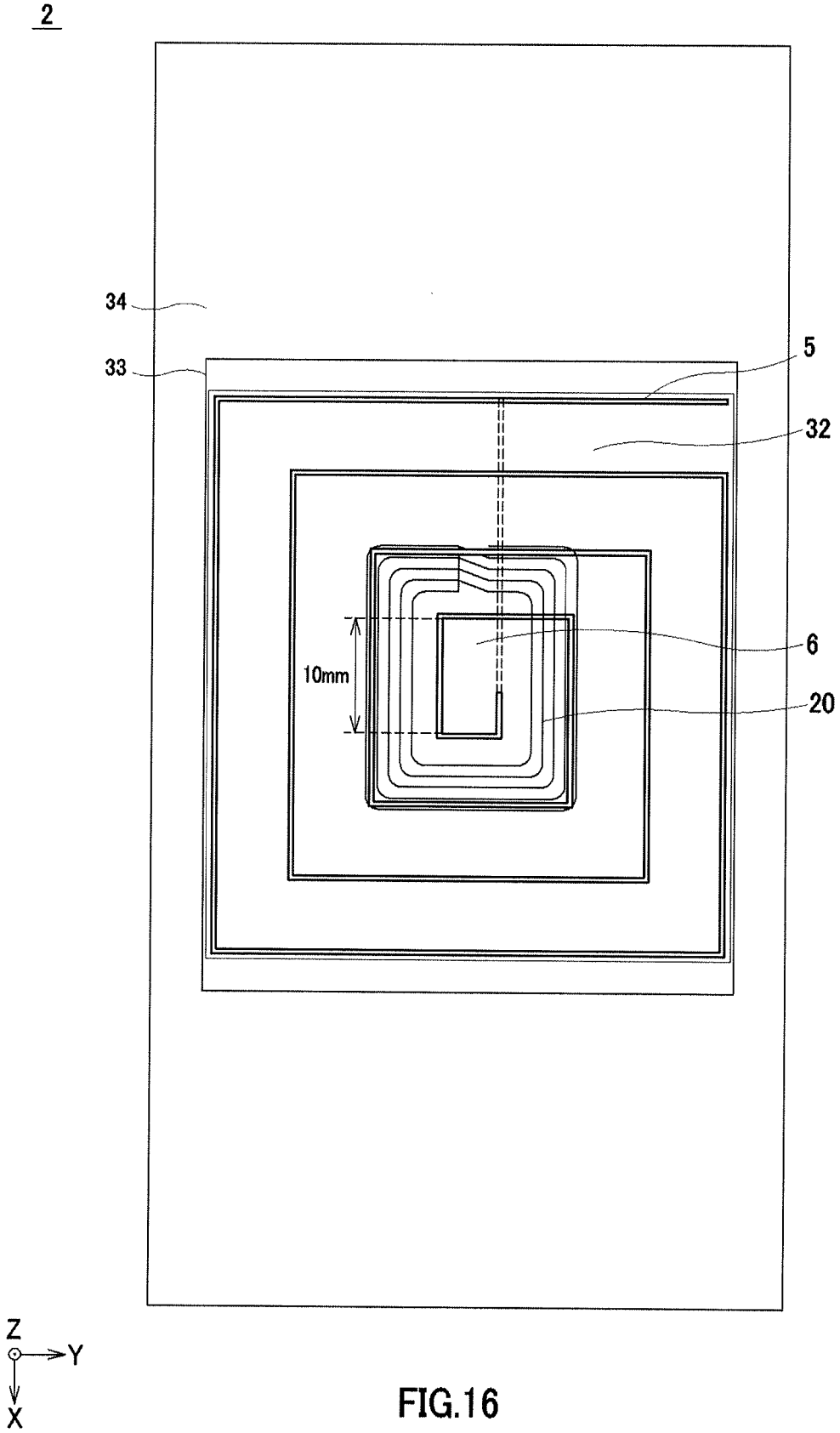
FIG. 16 is a plan view illustrating an Example in which the length of the long side of the innermost perimeter of an antenna pattern is 10 mm.

Next, for an antenna module 2 in which an antenna pattern is formed with an uniform pitch over the entire perimeter, the coupling coefficient K between the foregoing small antenna coil 20 and an antenna coil of the antenna module 2 was evaluated with varying the diameter of the innermost perimeter of an antenna pattern. Specifically, in the antenna module 2 according to the present embodiment, the length of the long side of the innermost perimeter of an antenna pattern was varied from 40 mm (FIG. 15) to 10 mm (FIG. 16).

There was used the antenna module 2 having a 53 mm×48 mm external shape similar to the small antenna coil 20 and having a coil of 4 turns with a pattern width of 0.5 mm. Furthermore, as is the case with Comparative Example 1, also in the antenna module 2 according to the present embodiment, the ferrite sheet 32 is overlaid with the entire surface of the antenna coil 5, and furthermore, the aluminum block 33 and the stainless steel plate 34 are superposed thereon.

Also in the antenna module 2 according to the present embodiment, as is the case with Comparative Example 1, the antenna coil 5 and the small antenna coil 20 were superposed in the XY-plane, and there was determined a coupling coefficient K in a state in which the centers of the antenna coil 5 and the small antenna coil 20 were made to coincide with each other.

Figure 17:
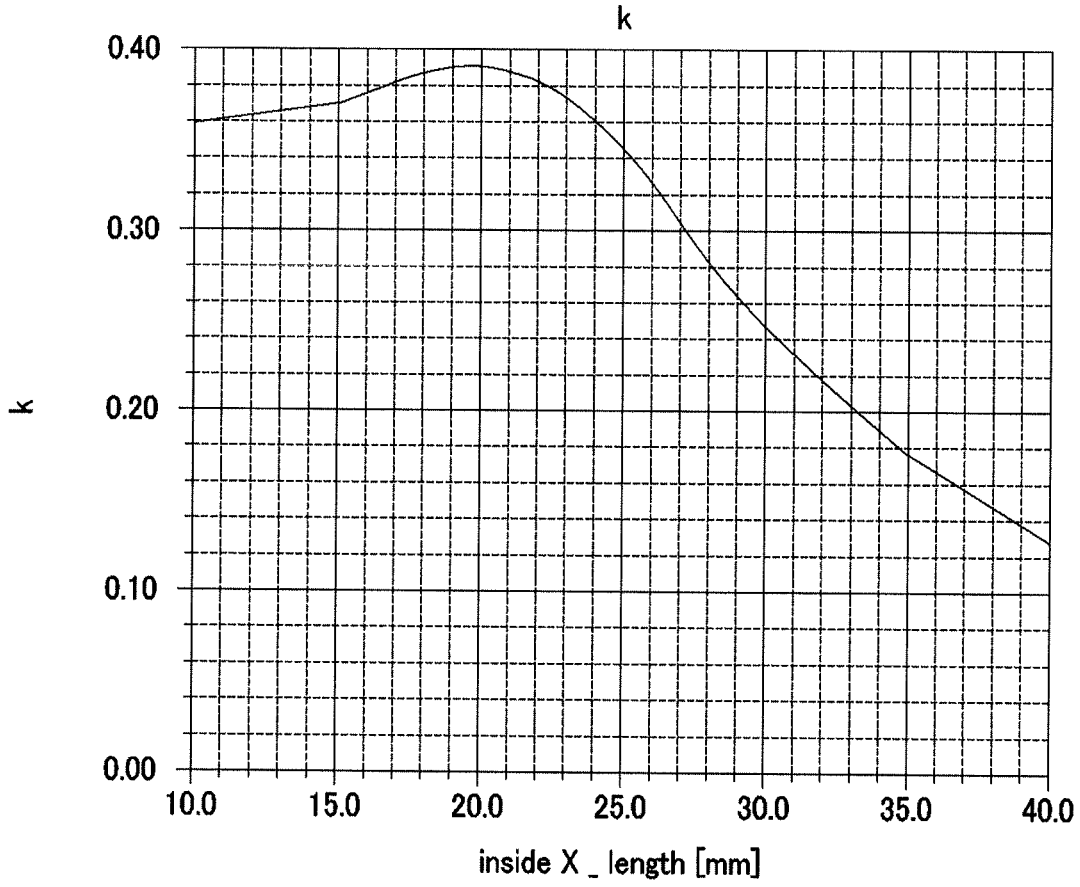
FIG. 17 is a graph showing coupling coefficients K between an antenna module and a smaller antenna coil, the coupling coefficient being obtained when the length of the long side of the innermost perimeter of an antenna pattern is varied.
Figure 18:
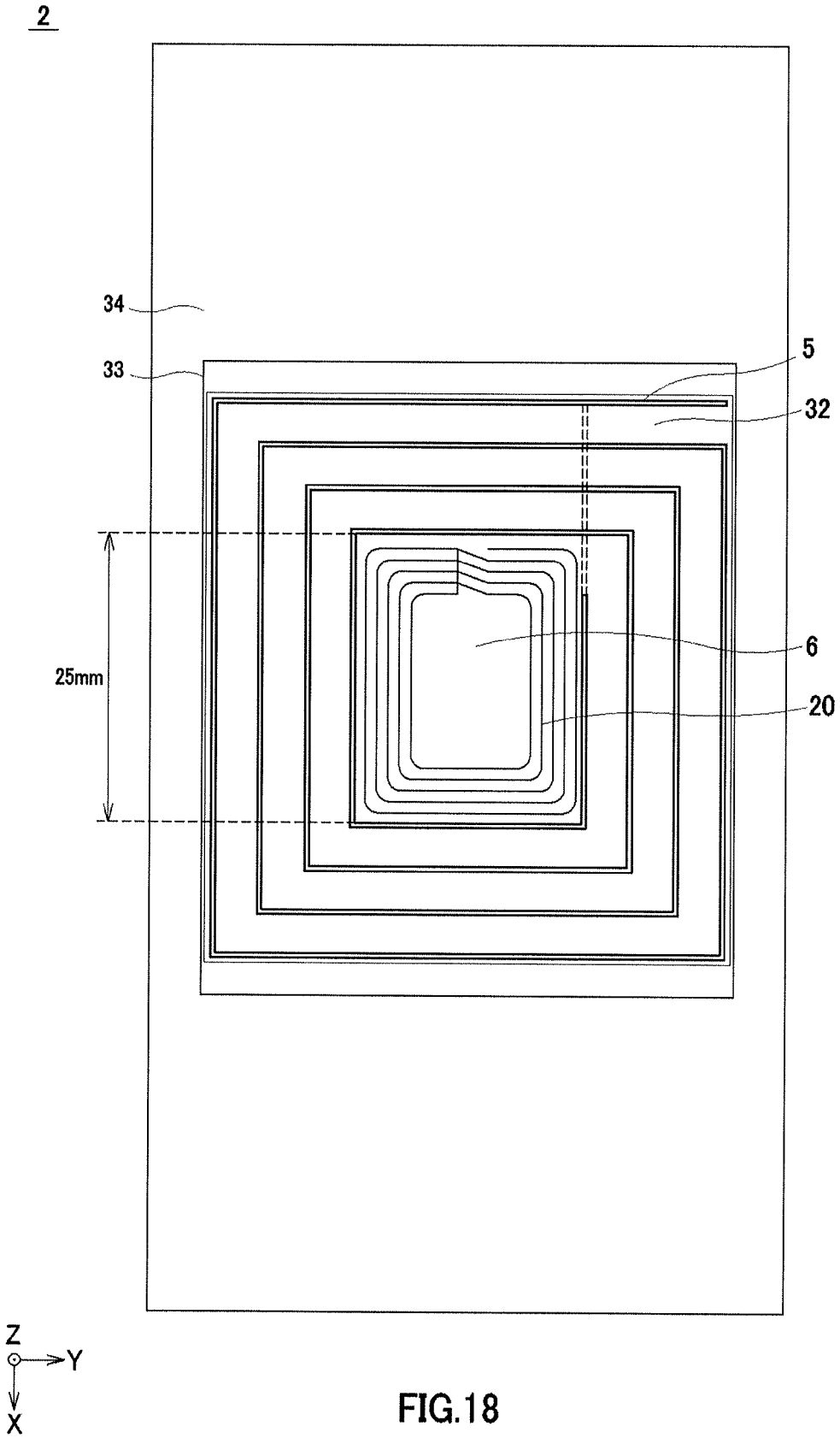
FIG. 18 is a plan view illustrating an Example in which the length of the long side of the innermost perimeter of an antenna pattern is 25 mm.

As shown in FIG. 17, in the antenna module 2, when the area of an opening portion 6 inside the innermost perimeter of the antenna pattern approximately coincides with the outside diameter area of the small antenna coil 20, in other words, when the length of the long side of the innermost perimeter of the antenna pattern is in the region of 25 mm (FIG. 18), communication characteristics are improved rapidly.

Figure 19:
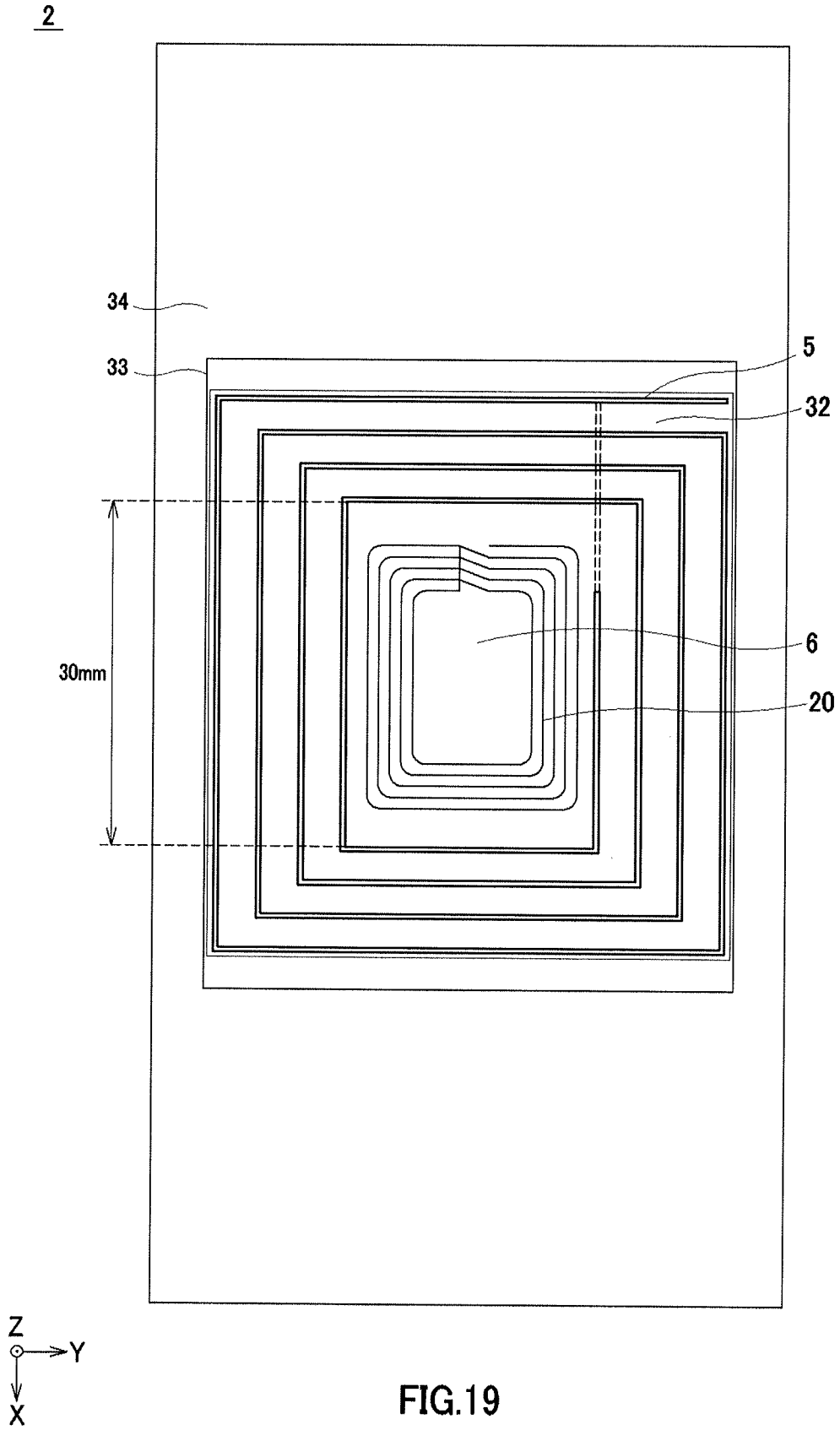
FIG. 19 is a plan view illustrating an Example in which the length of the long side of the innermost perimeter of an antenna pattern is 30 mm.

Practically, when the length of the long side of the innermost perimeter of the antenna pattern is not more than 30 mm (FIG. 19), excellent communication characteristics are achieved. In other words, in the antenna module 2, when the area of the opening portion inside the innermost perimeter of the antenna pattern is not more than 1.2 times (120%) as large as the outside diameter area of the small antenna coil 20, excellent communication characteristics are achieved.

REFERENCE SYMBOLS

2, 30 . . . antenna module, 4 . . . magnetic sheet, 5, 31 . . . antenna coil, 5*a* . . . larger diameter antenna portion, 5*b* . . . smaller diameter antenna portion, 6 . . . opening portion, 20 . . . small antenna coil, 32 . . . ferrite sheet, 33 . . . aluminum block, 34 . . . stainless steel plate, 60 . . . cellular phone, 70 . . . wireless communication system, 71 . . . reader/writer, 72 . . . antenna, 73 . . . memory module, 74 . . . control substrate, and 81 . . . battery pack.

The invention claimed is:

1. A wireless communication system, comprising:

a first antenna module including a first antenna coil; and a second antenna module including a second antenna coil and capable of communication by receiving a magnetic field transmitted from the first antenna module, wherein the first antenna coil and the second antenna coil have mutually different outside diameters, and wherein, out of the first and second antenna coils, an antenna coil having a larger outside diameter is formed in such a way that an area of an opening portion inside an innermost perimeter of an antenna pattern is not more than 120% of an outside diameter area of another antenna coil having a smaller outside diameter.

2. The wireless communication system according to claim 1, wherein the antenna coil having the larger outside diameter has: a larger diameter antenna portion in which an antenna pattern is wound in a plurality of turns; and a smaller diameter antenna portion provided on an inner perimeter side of the larger diameter antenna portion via a pitch larger than a pitch of the antenna pattern of the larger diameter antenna portion, and wherein an area of an opening portion inside an innermost perimeter of an antenna pattern of the smaller diameter antenna portion is not more than 120% of an outside diameter area of the second antenna coil.

3. The wireless communication system according to claim 2, wherein a pitch of the antenna pattern of the smaller diameter antenna portion is larger than a pitch of the antenna pattern of the larger diameter antenna portion.

4. The wireless communication system according to claim 2, wherein, in the antenna coil having the larger outside diameter, the antenna pattern has a uniform pitch.

5. The wireless communication system according to claim 1, wherein the first antenna coil and the second antenna coil each are formed so as to be approximately rectangular in shape, and, wherein, in the antenna coil having the larger outside diameter, a magnetic sheet is overlaid with each of two opposite sides of the antenna pattern.

6. The wireless communication system according to claim 1, wherein the antenna coil having the larger outside diameter is a first antenna coil.

7. An antenna module, comprising a first antenna coil and being configured to communicate by inductive coupling with a second antenna coil provided outside, wherein the first antenna coil has an outside diameter larger than an outside diameter of the second antenna coil, and is formed in such a way that an area of an opening portion inside an innermost perimeter of an antenna pattern is not more than 120% of an outside diameter area of the second antenna coil.

8. The antenna module according to claim 7, wherein the first antenna coil has: a larger diameter antenna portion in which an antenna pattern is wound in a plurality of turns; and a smaller diameter antenna portion provided on an inner perimeter side of the larger diameter antenna portion via a pitch larger than a pitch of the antenna pattern of the larger diameter antenna portion, and wherein an area of an opening portion inside an innermost perimeter of an antenna pattern of the smaller diameter antenna portion is not more than 120% of an outside diameter area of the second antenna coil.

9. The antenna module according to claim 8, wherein the pitch of the antenna pattern of the smaller diameter antenna portion is larger than a pitch of the antenna pattern of the larger diameter antenna portion.

10. The antenna module according to claim 7, wherein, in the first antenna coil, the antenna pattern has a uniform pitch.

11. The antenna module according to claim 7, wherein the first antenna coil and the second antenna coil each are formed so as to be approximately rectangular in shape, and, wherein, in the first antenna coil, a magnetic sheet is overlaid with each of two opposite sides of the antenna pattern.

12. An electronic device, having a built-in antenna module including a first antenna coil and being configured to communicate by inductive coupling with a second antenna coil provided outside, wherein the first antenna coil has an outside diameter larger than an outside diameter of the second antenna coil, and is formed in such a way that an area of an opening portion inside an innermost perimeter of an antenna pattern is not more than 120% of an outside diameter area of the second antenna coil.

13. An antenna module, comprising a first antenna coil and being configured to communicate by inductive coupling with a second antenna coil provided outside, wherein the first antenna coil has: a larger diameter antenna portion in which an antenna pattern is wound in a plurality of turns; and a smaller diameter antenna portion provided on an inner perimeter side of the larger diameter antenna portion via a pitch larger than a pitch of the antenna pattern of the larger diameter antenna portion, and wherein the smaller diameter antenna portion is connected in series or in parallel to the larger diameter antenna portion and configured with an antenna pattern wound in one turn.

14. A wireless communication system, comprising:

a first antenna module including a first antenna coil; and a second antenna module including a second antenna coil and capable of communication by receiving a magnetic field transmitted from the first antenna module, wherein the first antenna coil and the second antenna coil have mutually different outside diameters, and, wherein, out of the first and second antenna coils, an antenna coil having a larger outside diameter has: a larger diameter antenna portion in which an antenna pattern is wound in a plurality of turns; and a smaller diameter antenna portion provided on an inner perimeter side of the larger diameter antenna portion via a pitch larger than a pitch of the antenna pattern of the larger diameter antenna portion, and wherein the smaller diameter antenna portion is connected in series or in parallel with the larger diameter antenna portion and configured with an antenna pattern wound in one turn.

15. An electronic device, having a built-in antenna module including a first antenna coil and being configured to communicate by inductive coupling with a second antenna coil provided outside, wherein the first antenna coil has: a larger diameter antenna portion in which an antenna pattern is wound in a plurality of turns; and a smaller diameter antenna portion provided on an inner perimeter side of the larger diameter antenna portion via a pitch larger than a pitch of the antenna pattern of the larger diameter antenna portion, and wherein the smaller diameter antenna portion is connected in series or in parallel to the larger diameter antenna portion and configured with an antenna pattern wound in one turn.

16. An antenna module, comprising a first antenna coil and being configured to communicate by inductive coupling with a second antenna coil provided outside, wherein the first antenna coil has: a larger diameter antenna portion in which an antenna pattern is wound in a plurality of turns; and a smaller diameter antenna portion provided on an inner perimeter side of the larger diameter antenna portion via a pitch larger than a pitch of the antenna pattern of the larger diameter antenna portion, and wherein the smaller diameter antenna portion is connected in series or in parallel to the larger diameter antenna portion and configured with an antenna pattern wound in a plurality of turns.

17. A wireless communication system, comprising:

a first antenna module including a first antenna coil; and a second antenna module including a second antenna coil and capable of communication by receiving a magnetic field transmitted from the first antenna module, wherein the first antenna coil and the second antenna coil have mutually different outside diameters, and, wherein, out of the first and second antenna coils, an antenna coil having a larger outside diameter has: a larger diameter antenna portion in which an antenna pattern is wound in a plurality of turns; and a smaller diameter antenna portion provided on an inner perimeter side of the larger diameter antenna portion via a pitch larger than a pitch of the antenna pattern of the larger diameter antenna portion, and wherein the smaller diameter antenna portion is connected in series or in parallel to the larger diameter antenna portion and configured with an antenna pattern wound in a plurality of turns.

18. An electronic device, having a built-in antenna module including a first antenna coil and being configured to communicate by inductive coupling with a second antenna coil provided outside, wherein the first antenna coil has: a larger diameter antenna portion in which an antenna pattern is wound in a plurality of turns; and a smaller diameter antenna portion provided on an inner perimeter side of the larger diameter antenna portion via a pitch larger than a pitch of the antenna pattern of the larger diameter antenna portion, and wherein the smaller diameter antenna portion is connected in series or in parallel with the larger diameter antenna portion and configured with an antenna pattern wound in a plurality of turns.

* * * * *